US011246783B2

(12) United States Patent
Depauw

(10) Patent No.: US 11,246,783 B2
(45) Date of Patent: Feb. 15, 2022

(54) METHOD AND SYSTEM FOR POSITIONING A PATIENT

(71) Applicant: Ergotrics N.V., Turnhout (BE)

(72) Inventor: Paul Richard Alfons Maria Depauw, Turnhout (BE)

(73) Assignee: ERGOTRICS N. V., Turnhout (BE)

( * ) Notice: Subject to any disclaimer, the term of this patent is extended or adjusted under 35 U.S.C. 154(b) by 9 days.

(21) Appl. No.: 17/090,960

(22) Filed: Nov. 6, 2020

(65) Prior Publication Data

US 2021/0121350 A1 Apr. 29, 2021

Related U.S. Application Data

(62) Division of application No. 15/126,900, filed as application No. PCT/IB2015/051979 on Mar. 18, 2015, now abandoned.

(30) Foreign Application Priority Data

Mar. 18, 2014 (NL) ..... 2012460

(51) Int. Cl.
*A61G 13/12* (2006.01)

(52) U.S. Cl.
CPC ..... *A61G 13/1265* (2013.01); *A61G 13/122* (2013.01); *A61G 13/123* (2013.01)

(58) Field of Classification Search
CPC .. A47C 20/025; A47C 20/026; A47G 9/1054; A47G 9/1063; A61F 5/24; A61F 5/00;
(Continued)

(56) References Cited

U.S. PATENT DOCUMENTS 4,893,367 A 1/1990 Heimreid et al.
4,969,888 A * 11/1990 Scholten ..... A61B 17/8855 606/60

(Continued)

FOREIGN PATENT DOCUMENTS

| | | | |
|---|---|---|---|
| CA | 1035000 | A1 | 7/1978 |
| WO | 00/62731 | A1 | 10/2000 |
| WO | 2007146059 | A2 | 12/2007 |

OTHER PUBLICATIONS

Goldberg et al: "Positioning the Patient for Anorectal Surgical Procedures; Part A: The Prone Jack-Knife Position: The Gold Standard"; Ambulatory Anorectal Surgery pp. 46-50 (Year: 2000).*
Klein: "Prone Positioning in Patients with Acute Respiratory Distress Syndrome: The Vollman Prone Positioner"; Critical Care Nurse, vol. 19 No. 4, Aug. 1999; pp. 66-69 (Year: 1999).*

(Continued)

*Primary Examiner* — Caitlin A Carreiro
(74) *Attorney, Agent, or Firm* — Thomas|Horstemeyer, LLP

(57) ABSTRACT

A method for positioning a patient in a prone position including the following steps:

positioning a patient in a supine position, attaching to the chest of the patient an inflatable chest cushion in a deflated state, attaching to the pelvic region of the patient an inflatable pelvis cushion in a deflated state, transferring the patient from the supine position to a prone position, with the chest cushion attached to the chest and the pelvic cushion attached to the pelvic region and the patient in the prone position, inflating the chest cushion and the pelvis cushion, thereby providing that the chest cushion and the pelvis cushion together bear the weight of the torso of the patient with the abdominal region of the patient being decompressed.

(Continued)

The method provides reliable positioning the patient, which is safe for the patient and safe, hygienic and user friendly for the medical team.

11 Claims, 16 Drawing Sheets

(58) Field of Classification Search
CPC ..... A61F 5/37; A61G 13/12; A61G 13/1205; A61G 13/121; A61G 13/1215; A61G 13/122; A61G 13/1225; A61G 13/123; A61G 13/1235; A61G 13/124; A61G 13/1245; A61G 13/125; A61G 13/1255; A61G 13/126; A61G 13/1265; A61G 13/127; A61G 13/1275; A61G 13/128; A61G 13/1285; A61G 13/129; A61G 13/1295; A61G 7/10; A61G 1/00; A61G 7/001; A61G 7/05769; A61H 2201/0103; A61H 2201/0157; A61H 2201/1628; A61H 2201/1619; A61H 2201/165; A61H 2201/1652; A61H 2201/5056; A61H 2203/0456; A61H 2203/0468; A61H 2205/08; A61H 2205/082; A61H 2205/084; A61H 2205/088; A61B 5/0555; A61B 5/70; A61B 6/0485; A61B 6/04; A61B 2090/401
USPC .... 128/845, 846, 869, 870–874; 5/612, 613, 5/614, 615, 617, 618, 620, 624, 630, 631, 5/632, 648, 655.3, 655.9, 710, 722, 732, 5/930, 600; 297/452.32, 488; 606/240
See application file for complete search history.

(56) References Cited

U.S. PATENT DOCUMENTS

| | | | | |
|---|---|---|---|---|
| 4,989,591 | A | 2/1991 | Anders, Jr. | |
| 5,085,249 | A * | 2/1992 | Dragan | A61M 39/22 137/879 |
| 5,086,529 | A * | 2/1992 | DeGroot | A47C 27/001 5/710 |
| 6,154,903 | A | 12/2000 | Wai-Chung | |
| 6,324,710 | B1 | 12/2001 | Hernandez et al. | |
| 7,024,712 | B2 | 4/2006 | Fujita et al. | |
| 7,591,029 | B2 | 9/2009 | Weedling et al. | |
| 2002/0138905 | A1* | 10/2002 | Bartlett | A61G 7/0513 5/607 |
| 2003/0139695 | A1* | 7/2003 | Riach | A61F 5/012 602/13 |
| 2005/0022822 | A1 | 2/2005 | Santilli et al. | |
| 2006/0236464 | A1* | 10/2006 | Beck | A61G 7/05776 5/713 |
| 2007/0095353 | A1 | 5/2007 | Ravikumar | |
| 2008/0142022 | A1 | 6/2008 | Biondo et al. | |
| 2011/0010863 | A1 | 1/2011 | Rubio | |
| 2012/0030878 | A1* | 2/2012 | Davenport | A61G 7/05776 5/655.3 |
| 2014/0326251 | A1 | 11/2014 | Trentacosta | |
| 2017/0181913 | A1* | 6/2017 | Depauw | A61G 13/123 |

OTHER PUBLICATIONS

Netherlands Search Report and Written Opinion of Application No. 2012460 date of completion Dec. 3, 2014.

International Search Report of Application No. PCT/IB2015/051979 dated Jun. 1, 2015.

* cited by examiner

METHOD AND SYSTEM FOR POSITIONING A PATIENT

CROSS-REFERENCE TO RELATED APPLICATIONS

This application is a division of U.S. patent application Ser. No. 15/126,900, filed Sep. 16, 2016, which is the National Stage of International Application No. PCT/IB2015/051979, filed Mar. 18, 2015, now expired, which claims the benefit of and priority to Netherlands Application No. 2012460, filed Mar. 18, 2014, the contents of all of which are incorporated by reference as if fully set forth herein.

TECHNICAL FIELD

The invention pertains to a method for positioning a patient in a prone position on a patient support structure and a patient positioner system for positioning a patient in a prone position on a patient support structure, e.g. during spinal surgery.

BACKGROUND

Many treatments, diagnostic methods or surgery on the neck or spine require a patient to be positioned in a prone position. In addition, some patients at an intensive care unit have to be ventilated in a prone position. Prone position means a face down position, and includes variants like the so called "jackknife position", in which the torso and the legs extend downwardly at an angle from the hips. Often, such treatments or surgery require preparation of the patient while the patient lies in a supine position, that is: on his back, for example the intubation of a patient prior to an operation.

It is known to position a patient on cushions on the patient support structure such as an operating table while the patient is undergoing treatment, diagnostics or surgery in a prone position. It is important that the patient is positioned well on the cushions during the operation. Improper positioning may cause a variety of health risks for the patient, for example due to increased intra abdominal pressure, compression of blood vessels, undue pressure on nerves, pressure or tension on the skin, pressure on the breasts of a female patient or—in case of a male patient—the genitals getting trapped. In particular when a patient is transferred into a prone position from a supine position, the position of the cushions relative to each other and the position of the patient on the cushions needs to be checked and often corrected in order to avoid such health risks for the patient. This is a physically demanding task for the medical team, which has to be carried out in an unfavorable ergonomic position, while standing next to and bending over the patient. Moreover, it is generally an unpleasant and unhygienic task.

It is known to use inflatable cushions to support a patient while said patient is undergoing treatment, diagnostics or surgery in a prone position, for example from US2010/257674.

Also WO2007/146059 discloses the use of inflatable cushions to support a patient, e.g. during surgery, in a prone position. The cushions of WO2007/146059 are arranged on a patient support, e.g. an operating table. When the patient is transferred laterally (e.g. from a bed onto the operating table) or transferred from a supine position to a prone position, the cushions may shift to an incorrect or otherwise undesired position relative to the patient or to the patient support. Correcting the position of the cushions relative to the patient or the patient support is physically very demanding for the medical team, because it requires lifting a heavy load while bending over the patient. This results in a high load on the back, in particular of the spine, of the person of the medical team that carries out the correction of the position of the cushions. This sometimes has to be done multiple times per day.

The invention aims to provide an improved method for positioning a patient in a prone position on a patient support structure and a patient positioner system for positioning a patient in a prone position on a patient support structure.

The invention provides a method for positioning a patient in a prone position on a patient support structure.

A first step in the method is to provide a patient positioner system, which patient positioner system comprises a disposable chest positioner assembly and a disposable pelvis positioner assembly.

The disposable chest positioner assembly comprises a chest body contact sheet and an inflatable chest cushion.

The chest body contact sheet is made of a soft material, e.g. a material that is also used to make surgical drapes. The chest body contact sheet has a front surface and a rear surface. The chest body contact sheet is on the rear surface provided with an upper adhesive zone, which upper adhesive zone is adapted to be attached to the skin of a patient in the vicinity of the clavicle. The chest body contact sheet is on the rear surface further provided with a lower adhesive zone, which lower adhesive zone is adapted to be attached to the skin of a patient in the vicinity of the lower ribs. The upper adhesive zone is adapted to be attached to the skin of a patient in the vicinity of the clavicle can for example be reflected in the shape and/or position of the upper adhesive zone and in the type of adhesive that is used (e.g. skin-friendly adhesive). The lower adhesive zone is adapted to be attached to the skin of a patient in the vicinity of the lower ribs can for example be reflected in the shape and/or position of the lower adhesive zone, its distance to the upper adhesive zone and in the type of adhesive that is used (e.g. skin-friendly adhesive).

The upper adhesive zone can for example be formed by an adhesive strip that is arranged in the upper part of the chest body contact sheet. Alternatively or in addition, the upper adhesive zone can for example be formed by a part of an adhesive strip that extends into the upper part of the chest body contact sheet. Likewise, lower adhesive zone can for example be formed by an adhesive strip that is arranged in the lower part of the chest body contact sheet. Alternatively or in addition, the lower adhesive zone can for example be formed by a part of an adhesive strip that extends into the lower part of the chest body contact sheet.

The inflatable chest cushion is permanently attached to the front surface of the chest body contact sheet between the upper adhesive zone and the lower adhesive zone. The inflatable chest cushion has an deflated state and an inflated state.

The disposable pelvis positioner assembly comprises a pelvic body contact sheet and an inflatable pelvis cushion.

The pelvic body contact sheet is made of a soft material. The pelvic body contact sheet has a front surface and a rear surface. The pelvic body contact sheet is on the rear surface provided with an upper adhesive zone, which upper adhesive zone is adapted to be attached to the skin of a patient below but adjacent to the lower edge of the abdomen. The pelvic body contact sheet is on the rear surface further provided with a lower adhesive zone, which lower adhesive zone is adapted to be attached to the skin of a patient just above the inguinal region. The upper adhesive zone is adapted to be attached to the skin of a patient below but adjacent to the lower edge of the abdomen can for example be reflected in the shape and/or position of the upper adhesive zone and in the type of adhesive that is used (e.g. skin-friendly adhesive). The lower adhesive zone is adapted to be attached to the skin of a patient just above the inguinal region can for example be reflected in the shape and/or position of the lower adhesive zone, its distance to the upper adhesive zone and in the type of adhesive that is used (e.g. skin-friendly adhesive).

The upper adhesive zone can for example be formed by an adhesive strip that is arranged in the upper part of the pelvic body contact sheet. Alternatively or in addition, the upper adhesive zone can for example be formed by a part of an adhesive strip that extends into the upper part of the pelvic body contact sheet. Likewise, lower adhesive zone can for example be formed by an adhesive strip that is arranged in the lower part of the pelvic body contact sheet. Alternatively or in addition, the lower adhesive zone can for example be formed by a part of an adhesive strip that extends into the lower part of the pelvic body contact sheet.

The inflatable pelvis cushion is permanently attached to the front surface of the pelvic body contact sheet between the upper adhesive zone and the lower adhesive zone. The inflatable pelvis cushion has an deflated state and an inflated state.

The next steps in the method according to the invention are:

positioning a patient in a supine position on the patient support structure, for example a bed or table, attaching the chest body contact sheet of the disposable chest positioner assembly to the chest of the patient by attaching the upper adhesive zone of the chest body contact sheet to the skin of a patient in the vicinity of the clavicle of the patient and attaching the lower adhesive zone of the chest body contact sheet to the skin of a patient in the vicinity of the lower ribs of the patient, with the inflatable chest cushion of the disposable chest positioner assembly in the deflated state, attaching the pelvic body contact sheet of the disposable pelvis positioner assembly to the pelvic region of the patient by attaching the upper adhesive zone of the pelvic body contact sheet to the skin of a patient just below the abdominal region of the patient and attaching the lower adhesive zone of the pelvic body contact sheet to the skin of a patient just above the inguinal region of the patient, with the inflatable pelvis cushion of the disposable pelvis positioner assembly in the deflated state, transferring the patient from the supine position to a prone position, thereby making the patient come to lie on the patient support structure in a prone position, with the chest body contact sheet attached to the chest of the patient and the pelvic body contact sheet attached to the pelvic region of the patient and the patient in the prone position, inflating the chest cushion and the pelvis cushion, thereby lifting the patient from the patient support structure by making that the chest cushion and the pelvis cushion together bear the weight of the torso of the patient while the patient is in a prone position with the abdominal region of the patient being decompressed.

The chest cushion and the pelvis cushion can be inflated simultaneously or subsequently (one after the other).

Generally, the inflated chest cushion and the inflated pelvis cushion together bear more than 50% of the weight of the patient. Optionally, the inflated chest cushion and the inflated pelvis cushion together bear more than 75% of the weight of the patient.

The invention further provides a patient positioner system for positioning a patient in a prone position on a patient support structure, which patient positioner system comprises a disposable chest positioner assembly and a disposable pelvis positioner assembly.

The chest positioner assembly comprises a chest body contact sheet and an inflatable chest cushion.

The chest body contact sheet is made of a soft material. The chest body contact sheet has a front surface and a rear surface. The chest body contact sheet is on the rear surface provided with an upper adhesive zone, which upper adhesive zone is adapted to be attached to the skin of a patient in the vicinity of the clavicle. The chest body contact sheet is on the rear surface further provided with a lower adhesive zone, which lower adhesive zone is adapted to be attached to the skin of a patient in the vicinity of the lower ribs.

That the upper adhesive zone is adapted to be attached to the skin of a patient in the vicinity of the clavicle can for example be reflected in the shape and/or position of the upper adhesive zone and in the type of adhesive that is used (e.g. skin-friendly adhesive). That the lower adhesive zone is adapted to be attached to the skin of a patient in the vicinity of the lower ribs can for example be reflected in the shape and/or position of the lower adhesive zone, its distance to the upper adhesive zone and in the type of adhesive that is used (e.g. skin-friendly adhesive).

The inflatable chest cushion is permanently attached to the front surface of the chest body contact sheet between the upper adhesive zone and the lower adhesive zone. The inflatable chest cushion has an deflated state and an inflated state. In the patient positioner system according to the invention, the inflatable chest cushion—when the disposable chest positioner assembly is attached to a patient—in its inflated state has a shape that leaves the abdominal region of the patient decompressed.

The disposable pelvis positioner assembly comprises a pelvic body contact sheet and an inflatable pelvis cushion.

The pelvic body contact sheet is made of a soft material. The pelvic body contact sheet has a front surface and a rear surface. The pelvic body contact sheet is on the rear surface provided with an upper adhesive zone, which upper adhesive zone is adapted to be attached to the skin of a patient below but adjacent to the lower edge of the abdomen. The pelvic body contact sheet is on the rear surface further provided with a lower adhesive zone, which lower adhesive zone is adapted to be attached to the skin of a patient just above the inguinal region.

That the upper adhesive zone is adapted to be attached to the skin of a patient below but adjacent to the lower edge of the abdomen can for example be reflected in the shape and/or position of the upper adhesive zone and in the type of adhesive that is used (e.g. skin-friendly adhesive). That the lower adhesive zone is adapted to be attached to the skin of a patient just above the inguinal region can for example be reflected in the shape and/or position of the lower adhesive zone, its distance to the upper adhesive zone and in the type of adhesive that is used (e.g. skin-friendly adhesive).

The inflatable pelvis cushion is permanently attached to the front surface of the pelvic body contact sheet between the upper adhesive zone and the lower adhesive zone. The inflatable pelvis cushion has an deflated state and an inflated state. In the patient positioner system according to the invention, the inflatable pelvis cushion—when the disposable pelvis positioner assembly is attached to a patient—in its inflated state has a shape that leaves the abdominal region of the patient decompressed, In the patient positioner system according to the invention, the inflatable chest cushion and the inflatable pelvis cushion are adapted to in their inflated state together support the torso of the patient on the patient support structure while leaving the abdominal region of the patient decompressed. Generally, the inflated chest cushion and the inflated pelvis cushion together bear more than 50% of the weight of the patient. Optionally, the inflated chest cushion and the inflated pelvis cushion together bear more than 75% of the weight of the patient.

In a possible embodiment, the chest cushion comprises a rear wall, and in the inflated state, the rear wall of the chest cushion has a neck side edge and an abdominal side edge. This neck side edge and this abdominal side edge have a concave (i.e. hollow) shape having a radius of curvature. The radius of curvature of the neck side edge of the rear wall is larger than the radius of curvature of the abdominal side edge of the rear wall.

In this embodiment, optionally the rear wall the chest cushion is wider at its neck side edge than at its abdominal side edge.

In this embodiment, optionally the distance between the neck side edge and the abdominal side edge of the rear wall at the center of the chest cushion is substantially equal to the length of a human breast bone. "Substantially equal to the length of a human breast bone" means that this distance not more than 150 millimeter longer and no more than 150 millimeter shorter than the normal length of a human breastbone. In practical embodiments, this distance is for example between 200 millimeter and 375 millimeter, preferably between 250 millimeter and 375 millimeter or between 200 millimeter and 300 millimeter.

In this embodiment, optionally the chest cushion further comprises a front wall, wherein in the inflated state, the front wall of the chest cushion has a neck side edge and an abdominal side edge, wherein said neck side edge and abdominal side edge have a concave shape having a radius of curvature, wherein the radius of curvature of the neck side edge of the front wall is larger than the radius of curvature of the abdominal side edge of the front wall, and wherein the distance between the neck side edge and the abdominal side edge of the front wall at the center of the chest cushion is substantially equal to the length of a human breast bone, wherein optionally the front wall of the chest cushion is wider at its neck side edge than at its abdominal side edge.

In a possible embodiment, the pelvis cushion comprises a rear wall, and in the inflated state, the rear wall of the pelvis cushion has an abdominal side edge and a genital side edge. This abdominal side edge and genital side edge have a concave (i.e. hollow) shape having a radius of curvature. The radius of curvature of the abdominal side edge of the rear wall is larger than the radius of curvature of the genital side edge of the rear wall.

Optionally, in this embodiment, the distance between the abdominal side edge and the genital side edge of the rear wall at the center of the pelvis cushion is substantially equal to the distance between the lower edge of the abdomen and the upper edge of the exterior genitals in a human. "Substantially equal to the distance between the lower edge of the abdomen and the upper edge of the exterior genitals in a human" means that this distance not more than 100 millimeter longer and no more than 100 millimeter shorter than the normal length of this distance. In practical embodiments, this distance is for example between 50 millimeter and 250 millimeter, preferably between 100 millimeter and 200 millimeter.

In this embodiment, optionally the pelvis cushion further comprises a front wall, wherein in the inflated state, the front wall of the pelvis cushion has an abdominal side edge and a genital side edge, wherein said abdominal side edge and genital side edge have a concave shape having a radius of curvature, wherein the radius of curvature of the abdominal side edge of the front wall is larger than the radius of curvature of the genital side edge of the front wall, and wherein the distance between the abdominal side edge and the genital side edge of the front wall at the center of the pelvis cushion is substantially equal to the distance between the lower edge of the abdomen and the upper edge of the exterior genitals in a human.

In a possible embodiment, the rear surface of the chest body contact sheet forms part of the outer surface of the inflatable chest cushion.

In a possible embodiment, the rear surface of the pelvic body contact sheet forms part of the outer surface of the inflatable pelvis cushion.

In a different embodiment of the general inventive idea, the invention provides a disposable patient positioner system for positioning a patient in a prone position on a patient support structure, which disposable patient positioner system comprises:

a disposable chest positioner assembly, which disposable chest positioner assembly comprises a disposable inflatable chest cushion, which chest cushion comprises a rear wall, wherein the rear wall of the chest cushion comprises a chest body contact sheet which is made of a soft material, which chest body contact sheet has a rear surface which forms part of the outer surface of the chest cushion, which chest body contact sheet is on the rear surface provided with at least one adhesive zone, which adhesive zone is adapted to be attached to the skin of a patient in the chest area, wherein the disposable inflatable chest cushion has a deflated state and an inflated state, wherein in the inflated state, the rear wall of the chest cushion has a neck side edge and an abdominal side edge, wherein said neck side edge and abdominal side edge have a concave shape having a radius of curvature, wherein the radius of curvature of the neck side edge of the rear wall is larger than the radius of curvature of the abdominal side edge of the rear wall, and wherein the distance between the neck side edge and the abdominal side edge of the rear wall at the center of the chest cushion is substantially equal to the length of a human breast bone, and a disposable pelvis positioner assembly, which disposable pelvis positioner assembly comprises a disposable inflatable pelvis cushion, which pelvis cushion comprises a rear wall, wherein the rear wall of the pelvis cushion comprises a pelvic body contact sheet which is made of a soft material, which pelvic body contact sheet has a rear surface which forms part of the outer surface of the pelvis cushion, which pelvic body contact sheet is on the rear surface provided with at least one adhesive zone, which adhesive zone is adapted to be attached to the skin of a patient in the pelvis area, wherein the disposable inflatable pelvis cushion has a deflated state and an inflated state, wherein in the inflated state, the rear wall of the pelvis cushion has an abdominal side edge and a genital side edge, wherein said abdominal side edge and genital side edge have a concave shape having a radius of curvature, wherein the radius of curvature of the abdominal side edge of the rear wall is larger than the radius of curvature of the genital side edge of the rear wall, and wherein the distance between the abdominal side edge and the genital side edge of the rear wall at the center of the pelvis cushion is substantially equal to the distance between the lower edge of the abdomen and the upper edge of the exterior genitals in a human, wherein the inflatable chest cushion and the inflatable pelvis cushion are adapted to in their inflated state together support the torso of the patient on the patient support structure and wherein the shape of the inflatable chest cushion and the inflatable pelvis cushion in their inflated state allows to leave the abdominal region of the patient decompressed.

"Substantially equal to the length of a human breast bone" means that this distance not more than 150 millimeter longer and no more than 150 millimeter shorter than the normal length of a human breastbone. In practical embodiments, this distance is for example between 200 millimeter and 375 millimeter, preferably between 250 millimeter and 375 millimeter or between 200 millimeter and 300 millimeter.

"Substantially equal to the distance between the lower edge of the abdomen and the upper edge of the exterior genitals in a human" means that this distance not more than 100 millimeter longer and no more than 100 millimeter shorter than the normal length of this distance. In practical embodiments, this distance is for example between 50 millimeter and 250 millimeter, preferably between 100 millimeter and 200 millimeter.

In both main variants of the general inventive idea and their respective embodiments, the abdominal region of the patient is kept decompressed when the patient is in the prone position. So, compression of the abdominal region is avoided when the patient is in the prone position.

Keeping the abdominal region of the patient decompressed implies that the inflatable chest cushion and the inflatable pelvis cushion do not engage the patient in the abdominal region. This is not only comfortable for the patient, but also particularly advantageous during spinal surgery as it prevents excessive bleeding. Such excessive bleeding may occur due to increased intra-abdominal venous pressure when the patient is supported in such a way that the abdominal region bears part of the weight of the torso.

In case of such an increase of the abdominal pressure, venous blood is pushed through the valveless plexus of Batson into the vertebral venous system. This a because there is a free communication via a valveless system between the veins throughout the vertebral canal with those of the chest, abdomen and pelvis through the intercostal, lumbar and other connecting veins.

Reducing the intra-abdominal pressure or preventing an undesired increase in intra-abdominal pressure is also important in cases of prone ventilation. Prone ventilation is often used in the ICU (intensive care unit) in cases of acute respiratory failure. Prone ventilation ameliorates the underlying physical strain and generation of inflammatory mediators that compound ventilator induced lung injury. The presence of atelectasis and lung recruitability is the most important reason for the prone ventilation. In these cases exact positioning of the thoracopelvic supports are important for three reasons: to redistribute ventilatory gasses towards the now dependent ventral and diaphragmatic regions where atelectasis and collapse are present; to avoid compressing a noncompliant distended abdomen, especially if intra-abdominal hypertension (IAH) is present; and to potentially unload an abdomen of the lungs with sufficient abdominal compliance to allow this.

The method and patient positioner systems in accordance with the invention use a combination of anatomy and physiology to provide a reliable way of positioning the patient during treatment, diagnostics and/or surgery, which is safe for the patient as well as safe, hygienic and user friendly for the medical team.

The chest positioner assembly and the pelvis positioner assembly in principle are separate items. This makes it easier to handle and to attach them to a patient. Furthermore, this makes that the chest positioner assembly and the pelvis positioner assembly can be positioned accurately regardless of the length of the patient. In a possible embodiment, there may be a connection between chest positioner assembly and the pelvis positioner assembly, e.g. by a cord, but in general this will not be desired.

In accordance with the method and systems according to the invention, the chest positioner assembly and the pelvis positioner assembly are both disposable. They are intended for single use. This provides a more hygienic solution that the cushions that are known in the art, as the known cushions are re-used multiple times. The known cushions have to be cleaned for each subsequent patient, or a disposable sheet has to be provided on the known cushions. Such a sheet is often slippery and causes problems with the positioning of the patient, for example because the sheet shifts over the cushions when the patient is positioned. Furthermore, creases can occur that cause local high pressure on the body of the patient, which could result in lesions for the patient.

By attaching the disposable chest positioner assembly and the disposable pelvis positioner assembly according to the invention to the patient by the provided adhesive zones, a proper positioning of the disposable chest positioner assembly and the disposable pelvis positioner assembly relative to the patient remains ensured even after transferring the patient from a supine position to a prone position. This makes that the disposable chest positioner assembly and the disposable pelvis positioner assembly can be applied to the patient while the patient is in de the supine position. This is easier for the medical staff. Furthermore, it allows a more accurate positioning, as anatomical landmarks of the patient can be used for an accurate positioning of the disposable chest positioner assembly and the disposable pelvis positioner assembly. Examples of such anatomical landmarks are the clavicle, breastbone and or lower ribs for the chest positioner assembly and the lower edge of the abdomen and inguinal region for the pelvis positioner assembly.

The chest body contact sheet and the pelvic body contact sheet are made of a soft material, e.g. a textile or non-woven material of natural or synthetic fibers. These and similar materials are flexible and can form themselves at least generally to the shape of the body of the patient. Preferably, they have a pleasant touch and feel to the skin of the patient.

Preferably, one or more adhesive zones are provided for attachment of the disposable chest positioner assembly or the disposable pelvis positioner assembly, respectively, to these anatomical landmarks. Optionally, adhesive zones are provided on the rear surface of the chest body contact sheet or the pelvic body contact sheet, respectively, that generally match the shape and size of at least one of these anatomical landmarks as seen from the ventral side.

Optionally, the adhesive zone, optionally the upper adhesive zone of the disposable chest positioner assembly generally matches the shape and size of the clavicle as seen from the ventral side, and/or the adhesive zone, optionally the lower adhesive zone of the disposable chest positioner assembly generally matches the shape and size of the lower ribs as seen from the ventral side. Optionally, an additional adhesive zone provided on the rear of the chest body contact sheet of the disposable chest positioner assembly that generally matches the shape and size of the breastbone as seen from the ventral side. Of course, the distance between those adhesive zones and their relative position generally matches the distance between the clavicle, lower ribs and breastbone and their relative position.

Optionally, the adhesive zone, optionally the upper adhesive zone of the disposable pelvis positioner assembly generally matches the shape and size of the lower edge of the abdomen as seen from the ventral side, and/or the adhesive zone, optionally the lower adhesive zone of the disposable pelvis positioner assembly generally matches the shape and size of the inguinal region as seen from the ventral side. Of course, the distance between those adhesive zones and their relative position generally matches the distance between the lower edge of the abdomen and the inguinal region, and their relative position.

By inflating the chest cushion and the pelvis cushion after the patient has been transferred into the prone position, the patient is automatically positioned by the chest cushion and the pelvis cushion. This can easily be done by a single person and does not require physical force.

The method according to the invention and/or the use of the patient positioner system according to the invention make it possible to carry out treatments, diagnostic methods and/or surgery on a properly positioned patient lying in prone position, without having to use a dedicated patient support structure that is specifically adapted for supporting patients in prone position. For example, it is no longer necessary to use a spine table when performing spinal surgery.

For some treatments, diagnostic methods or operations, it is desired or necessary that the patient is positioned in a jackknife position. In such a position, the patient lies face down, with the hips at a level above the head and above the legs. This causes a larger opening of interlaminar window of the lumbar spine and can provide an easier access to the spinal canal for surgery.

In a possible embodiment of the invention, the pelvis cushion of the disposable pelvis positioner assembly in the inflated state is thicker than the chest cushion of the disposable chest positioner assembly in the inflated state. In this embodiment, the patient can be positioned in a jackknife position without the use of a specially adapted surgery table.

For some treatments, diagnostic methods or operations, it is desired or necessary that the patient is positioned with hyperflexion of the cervical spine. In this position, the head is bent forward such that the chin of the patient touches or almost touches the chest. This way, the back of the neck of the patient flexes to a large extend. This is necessary in case of surgery on the cervical spine via a posterior approach as in a cervical laminectomy procedure. This position is also needed in posterior fossa approaches in cranial neurosurgery In a possible embodiment of the invention, the chest cushion has in its inflated state a shape that leaves the clavicle and manubrium sterni free or at least does not extend beyond the clavicle and manubrium sterni. Optionally, in this embodiment, the upper adhesive zone and/or the upper edge of the chest body contact sheet has a shape that generally matches the shape and size of the clavicle and manubrium sterni In this embodiment, it is possible to position a patient in hyperflexion of the cervical spine.

The chest cushion and the pelvis cushion can be inflated using compressed air, which is generally available in e.g. operating rooms. However, in a possible embodiment, the patient positioner system according to the invention further comprises a pump that is connectable to the inflatable chest cushion and to the inflatable pelvis cushion, either subsequently or at the same time, to inflate said cushions.

In an advantageous embodiment of the method, at least one of the supraclavicular region, the lateral cutaneous nerve, the vena saphena magna, the arterie femoralis, the breasts (in case of a female patient) and/or the genital region of the patient is decompressed while the patient is in the prone position with the inflated pelvis cushion and the inflated chest cushion bearing the weight of the torso of said patient.

Likewise, in an advantageous embodiment of the system according to the invention, the inflatable pelvis cushion—when attached to a patient—in its inflated state has a shape that leaves the lateral cutaneous nerve, the vena saphena magna, the arterie femoralis and/or the genital region of the patient decompressed, and/or the inflatable chest cushion—when attached to a patient—in its inflated state has a shape that leaves supraclavicular region of the patient decompressed.

Leaving the supraclavicular region decompressed when the patient in in the prone position and the chest cushion and pelvis cushion carry the weight of the torso of the patient helps the patient to be ventilated easily and prevents compression of the blood vessels to and from the head. Furthermore, it makes hyperflexion of the cervical spine possible which is needed in some procedures.

Leaving the lateral cutaneous nerve in the thigh decompressed when the patient in in the prone position and the chest cushion and pelvis cushion carry the weight of the torso of the patient prevents meralgia paresthetica, which can occur due to sustained pressure on the lateral cutaneous nerve in the thigh.

Leaving the vena saphena magna and/or the arterie femoralis decompressed when the patient in in the prone position and the chest cushion and pelvis cushion carry the weight of the torso of the patient allows the inguinal region to be used for catheterization and prevents compression of the blood vessels.

Leaving the genital region decompressed when the patient in in the prone position and the chest cushion and pelvis cushion carry the weight of the torso of the patient, prevents damage to the genitalia of male patients, and makes it no longer necessary for the medical staff to check with the hand whether the male genitalia are in the correct position under the body of the patient. This is often regarded as an unpleasant task, which is also unhygienic.

Leaving the breasts (in case of a female patient) decompressed when the patient in in the prone position and the chest cushion and pelvis cushion carry the weight of the torso of the patient, prevents undue compression of the breasts.

In a possible embodiment of the system according to the invention, the chest body contact sheet of the disposable chest positioner assembly is on the rear surface further provided with a central adhesive zone. This central adhesive zone optionally as a shape that generally corresponds to the shape of a human breastbone or a part thereof as seen from the ventral side. The central adhesive zone is adapted to be attached to the skin of a patient in the vicinity of the breastbone.

When using a chest positioner assembly with such a central adhesive zone (for example in the method according to the invention), optionally this chest positioner assembly is attached to the patient by first attaching the central adhesive zone to the patient, preferably in the vicinity of the breast bone of the patient and then attaching the other adhesive zones to the patient.

In a possible embodiment of the method and/or system of the invention, the chest body contact sheet is further provided with a left adhesive zone and a right adhesive zone, so that the chest body contact sheet is attached to the patient's chest on four sides.

In a possible embodiment of the method and/or system of the invention, the pelvic body contact sheet is further provided with a left adhesive zone and a right adhesive zone, so that the pelvic body contact sheet is attached to the patient's pelvic region on four sides.

In a possible embodiment of the method and/or system of the invention, the chest body contact sheet is provided with an adhesive area, into which at least one adhesive zone is integrated. For example, in such an embodiment, an adhesive area is provided in the shape of a rectangle (optionally a rectangle with an open center), which rectangle includes the upper adhesive zone, the lower adhesive zone and optionally a left adhesive zone and a right adhesive zone.

In a possible embodiment of the method and/or system of the invention, the pelvic body contact sheet is provided with an adhesive area, into which at least one adhesive zone is integrated. For example, in such an embodiment, an adhesive area is provided in the shape of a rectangle (optionally a rectangle with an open center), which rectangle includes the upper adhesive zone, the lower adhesive zone and optionally a left adhesive zone and a right adhesive zone.

In a possible embodiment, the chest cushion and/or the pelvis cushion comprises multiple air chambers.

In a possible embodiment, the at least a part of the wall of the chest cushion is formed by at least a part of the chest body contact sheet.

In a possible embodiment, the at least a part of the wall of the pelvis cushion is formed by at least a part of the pelvic body contact sheet.

In a possible embodiment, the pelvic body contact sheet comprises a non-inflatable genital region covering flap. This non-inflatable genital region covering flap has a shape that—when the disposable pelvis positioner assembly is attached to a patient—extends over the genital region of the patient. The genital region covering flap prevents the male genitalia from getting trapped or otherwise coming to lie in an unfavorable or harmful position after the patient has been transferred from a supine position into a prone position. This further eliminates the need for the medical staff to check with the hand whether the male genitalia are in the correct position under the body of the patient.

In embodiments in which the pelvic body contact sheet forms part of the wall, e.g. part of the rear wall of the pelvis cushion, the non-inflatable genital region covering flap extends beyond the walls of the pelvis cushion. So, in these embodiments not the entire pelvic body contact sheet forms part of the wall of the pelvis cushion. In these embodiments, the pelvic body contact sheet comprises a first region which forms part of the wall, e.g. of the rear wall, of the pelvis cushion, and a second region which forms the non-inflatable genital region covering flap.

In a variant, the non-inflatable genital region covering flap is connected to the front of the pelvis cushion instead of to the rear of the pelvis cushion.

The genital region covering flap can further prevent that a urinary catheter gets folded or otherwise jammed under the patient while the patient is in or is moved into a prone position. For example, but not necessarily, the genital region covering flap may comprises a loop or other attachment means for attaching a urinary catheter to it.

Optionally, the non-inflatable genital region covering flap is provided with an attachment member that is adapted to attach the genital region covering flap to the upper leg of a patient. Such an attachment member can for example be a simple cord or string, optionally provided with a hook and loop fastener (for example a hook and loop fastener sold under the VELCRO® brand), to loosely attach the genital region covering flap to the upper leg of the patient. This generally is preferable to sticking the genital region covering flap to the upper leg of the patient, as the loose attachment gives the patient some freedom of movement.

In a possible embodiment, the chest body contact sheet comprises a pocket or fold, which pocket of fold is adapted in its shape, size and position on the body contact sheet to accommodate at least one breast of a female patient when the disposable chest positioner assembly is attached to said female patient. Preferably in this embodiment, either two pockets or folds are present, each adapted for accommodating a single breast of a female patient, or otherwise, one pocket or fold is present that is adapted to accommodate both breasts of the female patient.

In a variant of this embodiment, the rear wall of the inflatable chest cushion comprises the chest body contact sheet, which in this variant comprises a pocket or fold, which pocket of fold is adapted in its shape, size and position on the chest body contact sheet to accommodate at least one breast of a female patient when the disposable chest positioner assembly is attached to said female patient. In this variant, the rear wall of chest cushion in its inflated stated has a recess to accommodate at least one breast of a female patient. In practical embodiments, there will generally be either one recess in which both breasts can be accommodated or two recesses in each of which a single breast can be accommodated.

In a possible embodiment, the inflatable chest cushion in its inflated state projects between 5 cm and 25 cm from the front surface of the chest body contact sheet. Optionally, the inflatable chest cushion in its inflated state projects between 10 cm and 20 cm from the front surface of the chest body contact sheet.

In a possible embodiment, the inflatable pelvis cushion in its inflated state projects between 5 cm and 25 cm from the front surface of the pelvic body contact sheet. Optionally, the inflatable pelvis cushion in its inflated state projects between 10 cm and 20 cm from the front surface of the pelvic body contact sheet.

In a possible embodiment of the invention, the pelvis cushion of the disposable pelvis positioner assembly in the inflated state is thicker than the chest cushion of the disposable chest positioner assembly in the inflated state. For example, the inflatable chest cushion in its inflated state projects between 5 cm and 10 cm from the front surface of the chest body contact sheet and the inflatable pelvis cushion in its inflated state projects between 20 cm and 25 cm from the front surface of the pelvic body contact sheet. This allows to position the patient in a jackknife position without using a specially adapted surgery table.

In a possible embodiment, the chest cushion and/or the pelvis cushion has a non-symmetric shape in the inflated state. For example, the chest cushion may in its inflated state project further from the front surface of the chest body contact sheet in the vicinity of the lower ribs than in the vicinity of the clavicle, or the other way around. Furthermore, for example, the pelvis cushion may in its inflated state project further from the front surface of the pelvic body contact sheet in the vicinity of the lower edge of the abdomen than in the vicinity of the inguinal region, or the other way around.

In a possible embodiment, the chest cushion is provided with an air supply connector or a flexible air hose, wherein the air supply connector or flexible air hose is connected to the chest cushion at an air supply location at the chest cushion. The air supply location is located on a lateral side of the chest cushion in the inflated state, so that the patient does not lie on a hard part in the chest cushion. The lateral side of the chest cushion can for example be the peripheral wall of the chest cushion that is generally perpendicular to the patient in the inflated state of the chest cushion. Preferably, the air supply hose it at least 30 cm long, preferably at least 50 cm long.

In a possible embodiment, the pelvis cushion is provided with an air supply connector or a flexible air hose, wherein the air supply connector or flexible air hose is connected to the pelvis cushion at an air supply location at the pelvis cushion. The air supply location is located on a lateral side of the pelvis cushion in the inflated state, so that the patient does not lie on a hard part in the chest cushion. The lateral side of the chest cushion can for example be the peripheral wall of the pelvis cushion that is generally perpendicular to the patient in the inflated state of the pelvis cushion. Preferably, the air supply hose it at least 30 cm long, preferably at least 50 cm long.

In a possible embodiment, the chest cushion and/or the pelvis cushion is provided with a check valve in order to prevent undesired deflation of the cushion.

In a possible embodiment, the chest cushion and/or the pelvis cushion is provided with a pressure relief valve, optionally a manually operable pressure relieve valve. The pressure relief valve allows the a person of the medical team, e.g. the surgeon, to reduce the pressure in the cushion in case the pressure in the chest cushion and/or the pelvis cushion has become higher than desired, e.g. from the viewpoint of comfort for the patient. Optionally, in case of manually operable pressure relief valve, the pressure relief valve requires the use of two hands for actuation. This prevents on unintentional pressure release of the inflatable chest cushion and/or pelvis cushion, respectively.

In a possible embodiment, the chest cushion and/or the pelvis cushion is provided with a safety relief valve to prevent an unsafe pressure in the chest cushion and/or pelvis cushion, respectively.

In a possible embodiment, the chest cushion and/or the pelvis cushion is provided with a valve assembly which comprises at least two of a check valve, a pressure relief valve and a safety relief valve. Optionally, these valves are arranged in a common valve housing.

Optionally, the chest cushion and/or the pelvis cushion is provided with a valve assembly which comprises a check valve, a pressure relief valve and a safety relief valve, with the check valve, pressure relief valve and safety relief valve being arranged in are arranged in a common valve housing. Optionally, the pressure relief valve in this embodiment is a manually operable pressure relief valve, which requires the use of two hands for actuation.

This type of valve assembly can also be used in combination with other inflatable cushions for patient support, resulting a an inflatable cushion for patient positioning during diagnosis, treatment or surgery, which cushion is provided with a valve assembly which comprises a check valve, a pressure relief valve and a safety relief valve, with the check valve, pressure relief valve and safety relief valve being arranged in are arranged in a common valve housing, and wherein optionally, the pressure relief valve is a manually operable pressure relief valve which requires the use of two hands for actuation.

Optionally, regardless of whether the valve assembly is use din combination with an inflatable cushion of a patient positioner according to the invention or with an other type of inflatable cushion for patient support, the common valve housing has a length (seen in the direction of normal flow of pressure medium, e.g. air, through the valve) of less than 10 centimeter, optionally less than 5 centimeter.

The inflated chest cushion and the inflated chest cushion bear a significant amount of the weight of the patient. Therefore, the use of a check valve, pressure relief valve and/or safety relief valve (either as separate items or combined in a valve assembly) is advantageous, as it increases the safety and optionally also the comfort of the patient. The check valve prevents undesired return of pressurized air of other pressurizing medium from the cushion to the source of pressurized medium, therewith preventing undesired deflation of the cushion. The safety relief valve prevents that the pressure in the cushion becomes too high from a safety point of view. The pressure relief valve allows to reduce the pressure in the inflated cushion as desired by the medical team, e.g. to increase the comfort of the patient or to obtain a suitable working height of for the medical team.

It is not necessary that a check valve, pressure relief valve and/or safety relief valve are provided as part of the patient positioner according to the invention. It is for example also possible that one or more of such valves or valves having similar functions are provided in the room where the patient positioner according to the invention is used, e.g. as part of a central pressurized air supply system of the hospital.

In a possible embodiment, the patient positioner according to the invention further comprises a pressure sensing device which is adapted to measure and/or monitor the pressure in the chest cushion and/or in the pelvis cushion.

The pressure sensing device can for example comprise a pressure sensor which is arranged in or connected to the chest cushion and/or to the pelvis cushion. The pressure sensor measures the pressure in the chest cushion and/or in the pelvis cushion, respectively. Optionally, the pressure sensor is connectable to an external monitoring device, which is adapted to monitor one or more parameters of the patient and/or of the medical devices in use.

Optionally, the pressure sensing device also comprises a alarm device, which is adapted to trigger an alarm when the pressure in a cushion has become either too high or too low. This alarm then alerts the medical team, e.g. the medical team of an intensive care unit, to correct the pressure in the cushion. An advantage of the alarm device is that the pressure in the cushion or cushions does not need to be constantly or periodically be monitored by e.g. staff of the intensive care unit. They only will have to take action to correct the pressure when the alarm has been triggered by the alarm device.

Optionally, the pressure sensing device further comprises a pressure controller, which is adapted to control the pressure in the chest cushion and/or in the pelvis cushion.

An embodiment with a pressure sensing device is in particular advantageous for use in an intensive care unit, because in an intensive care unit the patient positioner according to the invention will generally be used for a longer period of time than e.g. during surgery.

In a possible embodiment, the rear wall of the chest cushion and/or the chest body contact sheet has a hollow shape. Optionally, this hollow shape substantially follows the generally convex shape of a human chest.

In a possible embodiment, the invention pertains to a patient positioner system which is arranged in a packaging, wherein the packaging comprises and/or contains instructions to:

attach the chest body contact sheet of the disposable chest positioner assembly to the chest of the patient by attaching the upper adhesive zone of the chest body contact sheet to the skin of a patient in the vicinity of the clavicle of the patient and attaching the lower adhesive zone of the chest body contact sheet to the skin of a patient in the vicinity of the lower ribs of the patient, and attach the pelvic body contact sheet of the disposable pelvis positioner assembly to the pelvic region of the patient by attaching the upper adhesive zone of the pelvic body contact sheet to the skin of a patient just below the abdominal region of the patient and attaching the lower adhesive zone of the pelvic body contact sheet to the skin of a patient just above the inguinal region of the patient, and transfer the patient from the supine position to a prone position, and with the chest body contact sheet attached to the chest of the patient and the pelvic body contact sheet attached to the pelvic region of the patient and the patient in the prone position, to inflate the chest cushion and the pelvis cushion, and wherein the patient positioner system is a patient positioner system for positioning a patient in a prone position on a patient support structure, which patient positioner system comprises:

a disposable chest positioner assembly, which disposable chest positioner assembly comprises:

a chest body contact sheet which is made of a soft material, which chest body contact sheet has a front surface and a rear surface, which chest body contact sheet is on the rear surface provided with an upper adhesive zone, which upper adhesive zone is adapted to be attached to the skin of a patient in the vicinity of the clavicle, which chest body contact sheet is on the rear surface further provided with a lower adhesive zone, which lower adhesive zone is adapted to be attached to the skin of a patient in the vicinity of the lower ribs, an inflatable chest cushion, which inflatable chest cushion is permanently attached to the front surface of the chest body contact sheet between the upper adhesive zone and the lower adhesive zone, wherein the inflatable chest cushion has an deflated state and an inflated state, wherein the inflatable chest cushion—when the disposable chest positioner assembly is attached to a patient—in its inflated state has a shape that leaves the abdominal region of the patient decompressed, a disposable pelvis positioner assembly, which disposable pelvis positioner assembly comprises:

a pelvic body contact sheet which is made of a soft material, which pelvic body contact sheet has a front surface and a rear surface, which pelvic body contact sheet is on the rear surface provided with an upper adhesive zone which upper adhesive zone is adapted to be attached to the skin of a patient below but adjacent to the lower edge of the abdomen, which pelvic body contact sheet is on the rear surface further provided with a lower adhesive zone, which lower adhesive zone is adapted to be attached to the skin of a patient just above the inguinal region, an inflatable pelvis cushion, which inflatable pelvis cushion is permanently attached to the front surface of the pelvic body contact sheet between the upper adhesive zone and the lower adhesive zone, wherein the inflatable pelvis cushion has an deflated state and an inflated state, wherein the inflatable pelvis cushion—when the disposable pelvis positioner assembly is attached to a patient—in its inflated state has a shape that leaves the abdominal region of the patient decompressed, wherein the inflatable chest cushion and the inflatable pelvis cushion are adapted to in their inflated state together support the torso of the patient on the patient support structure while leaving the abdominal region of the patient decompressed.

In a possible embodiment, the invention pertains to a patient positioner system which is arranged in a packaging, wherein the packaging comprises and/or contains instructions to:

attach the chest body contact sheet of the disposable chest positioner assembly to the chest of the patient by attaching the adhesive zone of the chest body contact sheet to the skin of the patient in the chest area, leaving the abdominal region free, and attach the pelvic body contact sheet of the disposable pelvis positioner assembly to the pelvic region of the patient by attaching the adhesive zone of the pelvic body contact sheet to the skin of the patient in the pelvic region, leaving the abdominal region free, and transfer the patient from the supine position to a prone position, and with the chest body contact sheet attached to the chest of the patient and the pelvic body contact sheet attached to the pelvic region of the patient and the patient in the prone position, to inflate the chest cushion and the pelvis cushion, and wherein the patient positioner system is a disposable patient positioner system for positioning a patient in a prone position on a patient support structure, which disposable patient positioner system comprises:

a disposable chest positioner assembly, which disposable chest positioner assembly comprises a disposable inflatable chest cushion, which chest cushion comprises a rear wall, wherein the rear wall of the chest cushion comprises a chest body contact sheet which is made of a soft material, which chest body contact sheet has a rear surface which forms part of the outer surface of the chest cushion, which chest body contact sheet is on the rear surface provided with at least one adhesive zone, which adhesive zone is adapted to be attached to the skin of a patient in the chest area, wherein the disposable inflatable chest cushion has a deflated state and an inflated state, wherein in the inflated state, the rear wall of the chest cushion has a neck side edge and an abdominal side edge, wherein said neck side edge and abdominal side edge have a concave shape having a radius of curvature, wherein the radius of curvature of the neck side edge of the rear wall is larger than the radius of curvature of the abdominal side edge of the rear wall, and wherein the distance between the neck side edge and the abdominal side edge of the rear wall at the center of the chest cushion is substantially equal to the length of a human breast bone, and a disposable pelvis positioner assembly, which disposable pelvis positioner assembly comprises a disposable inflatable pelvis cushion, which pelvis cushion comprises a rear wall, wherein the rear wall of the pelvis cushion comprises a pelvic body contact sheet which is made of a soft material, which pelvic body contact sheet has a rear surface which forms part of the outer surface of the pelvis cushion, which pelvic body contact sheet is on the rear surface provided with at least one adhesive zone, which adhesive zone is adapted to be attached to the skin of a patient in the pelvis area, wherein the disposable inflatable pelvis cushion has a deflated state and an inflated state, wherein in the inflated state, the rear wall of the pelvis cushion has an abdominal side edge and a genital side edge, wherein said abdominal side edge and genital side edge have a concave shape having a radius of curvature, wherein the radius of curvature of the abdominal side edge of the rear wall is larger than the radius of curvature of the genital side edge of the rear wall, and wherein the distance between the abdominal side edge and the genital side edge of the rear wall at the center of the pelvis cushion is substantially equal to the distance between the lower edge of the abdomen and the upper edge of the exterior genitals in a human, wherein the inflatable chest cushion and the inflatable pelvis cushion are adapted to in their inflated state together support the torso of the patient on the patient support structure and wherein the shape of the inflatable chest cushion and the inflatable pelvis cushion in their inflated state allows to leave the abdominal region of the patient decompressed.

The invention further pertains to a patient positioner system according to any of the clauses 4-25, found at the end of the Detailed Description section below, for use in positioning a patient in a prone position, preferably for positioning a patient in a prone position for spinal surgery.

The invention further pertains to a method for positioning a patient in a prone position on a patient support structure, which method comprises the following steps:

providing a patient positioner system according to any of the clauses 4-13, found at the end of the Detailed Description section below, positioning a patient in a supine position on the patient support structure, attaching the chest body contact sheet of the disposable chest positioner assembly to the chest of the patient by attaching the upper adhesive zone of the chest body contact sheet to the skin of a patient in the vicinity of the clavicle of the patient and attaching the lower adhesive zone of the chest body contact sheet to the skin of a patient in the vicinity of the lower ribs of the patient, with the inflatable chest cushion of the disposable chest positioner assembly in the deflated state, attaching the pelvic body contact sheet of the disposable pelvis positioner assembly to the pelvic region of the patient by attaching the upper adhesive zone of the pelvic body contact sheet to the skin of a patient just below the abdominal region of the patient and attaching the lower adhesive zone of the pelvic body contact sheet to the skin of a patient just above the inguinal region of the patient, with the inflatable pelvis cushion of the disposable pelvis positioner assembly in the deflated state, transferring the patient from the supine position to a prone position, thereby making the patient come to lie on the patient support structure in a prone position, with the chest body contact sheet attached to the chest of the patient and the pelvic body contact sheet attached to the pelvic region of the patient and the patient in the prone position, inflating the chest cushion and the pelvis cushion, thereby lifting the patient from the patient support structure by making that the chest cushion and the pelvis cushion together bear the weight of the torso of the patient while the patient is in a prone position with the abdominal region of the patient being decompressed.

The invention further pertains to a method for positioning a patient in a prone position on a patient support structure, which method comprises the following steps:

providing a disposable patient positioner system according to clause 5, found at the end of the Detailed Description section below, positioning a patient in a supine position on the patient support structure, attaching the chest body contact sheet of the disposable chest positioner assembly to the chest of the patient by attaching the adhesive zone of the chest body contact sheet to the skin of the patient in the chest area, leaving the abdominal region free, with the inflatable chest cushion of the disposable chest positioner assembly in the deflated state, attaching the pelvic body contact sheet of the disposable pelvis positioner assembly to the pelvic region of the patient by attaching the adhesive zone of the pelvic body contact sheet to the skin of the patient in the pelvic region, leaving the abdominal region free, with the inflatable pelvis cushion of the disposable pelvis positioner assembly in the deflated state, transferring the patient from the supine position to a prone position, thereby making the patient come to lie on the patient support structure in a prone position, with the chest body contact sheet attached to the chest of the patient and the pelvic body contact sheet attached to the pelvic region of the patient and the patient in the prone position, inflating the chest cushion and the pelvis cushion, thereby lifting the patient from the patient support structure by making that the chest cushion and the pelvis cushion together bear the weight of the torso of the patient while the patient is in a prone position with the abdominal region of the patient being decompressed.

BRIEF DESCRIPTION OF THE DRAWINGS

The invention will be described in more detail below under reference to the drawing, in which in a non-limiting manner, exemplary embodiments of the invention will be shown.

The drawing shows in.

DETAILED DESCRIPTION

Figure 1:
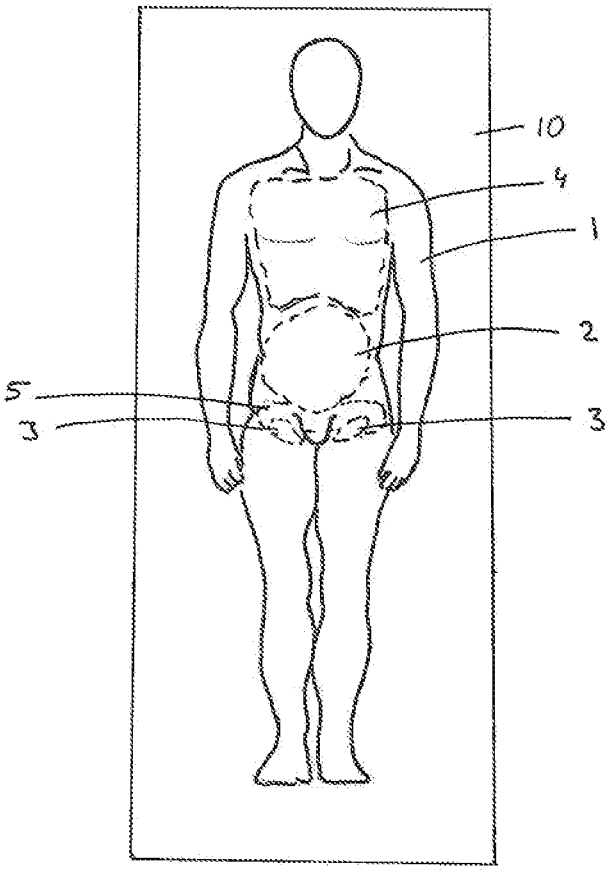
FIG. 1: a patient on a patient support structure, in supine position, viewed from above.

FIG. 1 shows a patient 1 on a patient support structure 10, in supine position, viewed from above.

In FIG. 1, the abdominal region 2 and the inguinal region 3 (left and right parts) of the patient 1 are indicated. Further indicated are the chest region 4 and the pelvic region 5.

Figure 2:
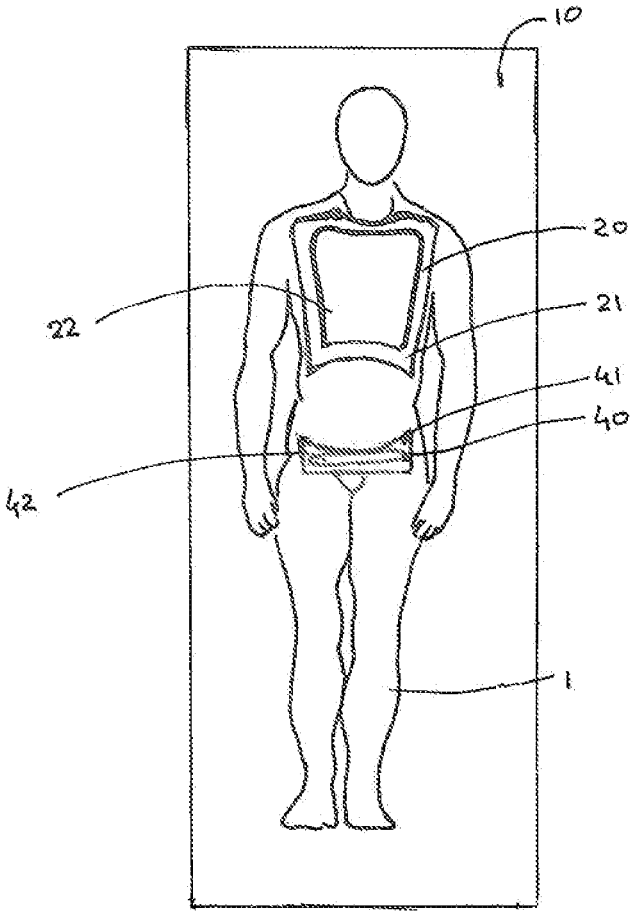
FIG. 2: a patient on a patient support structure, in supine position, viewed from above, with an embodiment of a chest positioner assembly and an embodiment of a pelvis positioner assembly according to the invention attached to said patient.

FIG. 2 shows a patient a on a patient support structure 10, in supine position, viewed from above. An embodiment of a disposable chest positioner assembly 20 and an embodiment of a disposable pelvis positioner assembly 40 according to the invention are attached to the patient 1.

The disposable chest positioner assembly 20 comprises a chest body contact sheet 21 and an inflatable chest cushion 22. The chest body contact sheet 21 is made of a soft material, for example a material that is used for surgical drapes.

The chest body contact sheet 21 has a front side and a rear side. On the rear side (not shown in FIG. 2), an upper adhesive zone and a lower adhesive zone are present that allow the disposable chest positioner assembly 20 to be attached to the patient 1. Attaching the disposable chest positioner assembly 20 to the patient 1 takes place while the patient is in a supine position.

The inflatable chest cushion 22 is permanently attached to the chest body contact sheet 21. When medical personnel, e.g. a nurse or a surgeon, attaches the disposable chest positioner assembly 20 to the patient 1, the inflatable chest cushion 22 is in its deflated state.

Attaching the chest body contact sheet 21 of the disposable chest positioner assembly 20 to the chest of the patient in this embodiment takes place by attaching the upper adhesive zone of the chest body contact sheet 21 to the skin of a patient 1 in the vicinity of the clavicle of the patient 1 and by attaching the lower adhesive zone of the chest body contact sheet 21 to the skin of a patient 1 in the vicinity of the lower ribs of the patient.

By doing so, the disposable chest positioner assembly 20 does not extend over the abdominal region 2 of the patient 1.

The disposable pelvis positioner assembly 40 comprises a pelvic body contact sheet 41 and an inflatable pelvis cushion 44. The pelvic body contact sheet 41 is made of a soft material, for example a material that is used for surgical drapes.

The pelvic body contact sheet 41 has a front side and a rear side. On the rear side (not shown in FIG. 4), adhesive zones are present that allow the disposable pelvis positioner assembly 40 to be attached to the patient 1. Attaching the disposable pelvis positioner assembly 40 to the patient 1 takes place while the patient is in the supine position.

The inflatable pelvis cushion 44 is permanently attached to the pelvic body contact sheet 41. When medical personnel, e.g. a nurse or a surgeon, attaches the disposable pelvis positioner assembly 40 to the patient 1, the inflatable pelvis cushion 44 is in its deflated state.

Attaching the pelvic body contact sheet 41 of the disposable pelvis positioner assembly 40 to the pelvic region 5 of the patient takes place by attaching the upper adhesive zone of the pelvic body contact sheet 41 to the skin of a patient just below the abdominal region 2 of the patient and by attaching the lower adhesive zone of the pelvic body contact sheet 21 to the skin of a patient 1 just above the inguinal region 3 of the patient 1.

By doing so, the disposable pelvis positioner assembly 40 does not extend over the abdominal region 2 of the patient 1.

It is possible that first the chest positioner assembly 20 is attached to the patient 1 and then the pelvis positioner assembly 40 is attached to the patient. Alternatively, it possible that first the pelvis positioner assembly 40 is attached to the patient 1 and then the chest positioner assembly 20. As a further alternative, t the chest positioner assembly 20 and the pelvis positioner assembly 40 are attached to the patient 1 substantially simultaneously, for example by two different people.

After the disposable chest positioner assembly 20 and the disposable pelvis positioner assembly 40 have been attached to the patient, the patient 1 is transferred from the supine position to a prone position. As a result, the patient 1 comes to lie on the patient support structure 10 in a prone position.

With the chest body contact sheet 21 attached to the chest 4 of the patient 1 and the pelvic body contact sheet 41 attached to the pelvic region 5 of the patient 1 and the patient 1 now being in the prone position, a subsequent step is inflating the chest cushion 22 and the pelvis cushion 42. By doing this, the patient 1 is lifted from the patient support structure 10 and the chest cushion 22 and the pelvis cushion 42 together bear the weight of the torso of the patient 1 while the patient is in a prone position on the patient support structure 10. The abdominal region 2 of the patient 1 is decompressed, as the chest cushion 22 and the pelvis cushion 42 in their inflated state do not extend over the abdominal region 2 of the patient 1.

The chest cushion and the pelvis cushion can be inflated simultaneously or subsequently (one after the other).

Figure 3:
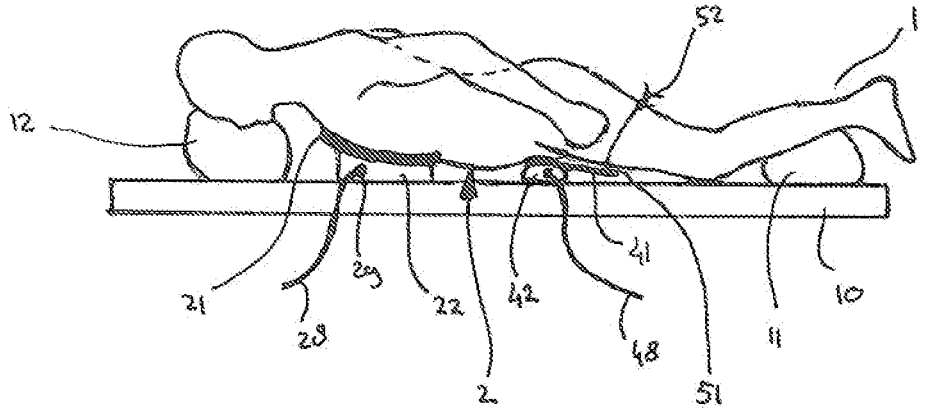
FIG. 3: a patient in prone position, positioned on a patient support structure by means of an embodiment of a chest positioner assembly and an embodiment of a pelvis positioner assembly according to the invention.

FIG. 3 shows the patient 1 in the prone position, positioned on the patient support structure 10 by means of the chest positioner assembly 20 the pelvis positioner assembly 40 after the chest cushion 22 and the pelvis cushion 42 have been inflated. FIG. 3 shows that the abdominal region 2 of the patient 1 is decompressed when the patient 1 is positioned in the prone position by the patient positioner system according to the invention. When using the method and system according the invention, the abdomen of the patient can freely bend out towards to patient support 10.

The chest cushion 22 and the pelvis cushion 42 together bear the weight of the torso of the patient 1 after they have been inflated. Generally, this is more than 50% of the total body weight. In the embodiment shown in FIG. 3, optionally further a head support 12 and a leg support 11 are provided. The optional head support 12 and the optional leg support 11 can be inflatable, but this is not necessary.

In FIG. 3, the thickness of the chest body contact sheet 21 and the pelvic body contact sheet 41 are shown in an exaggerated way. In practice, the chest body contact sheet 21 and the pelvic body contact sheet 41 will be quite thin.

In the embodiment of FIG. 2 and FIG. 3, as can be seen, the disposable chest positioner assembly 20 and the disposable pelvis positioner assembly 40 do not extend over the supraclavicular region, the lateral cutaneous nerve, the vena saphena magna, the arterie femoralis and the genital region of the patient 1 when they have been applied to the patient 1. In particular, the chest cushion 22 and the pelvis cushion 42 do not extend over these regions. As a consequence, the supraclavicular region, the lateral cutaneous nerve, the vena saphena magna, the arterie femoralis and the genital region of the patient are decompressed while the patient is in the prone position with the inflated pelvis cushion 42 and the inflated chest cushion 22 bearing the weight of the torso of said patient.

Figure 4:
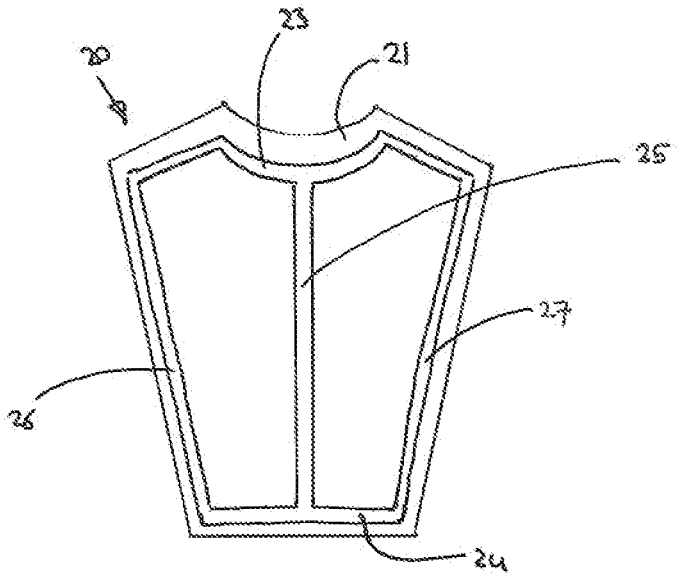
FIG. 4: an embodiment of a chest positioner assembly according to the assembly, seen on the rear side.
Figure 5:
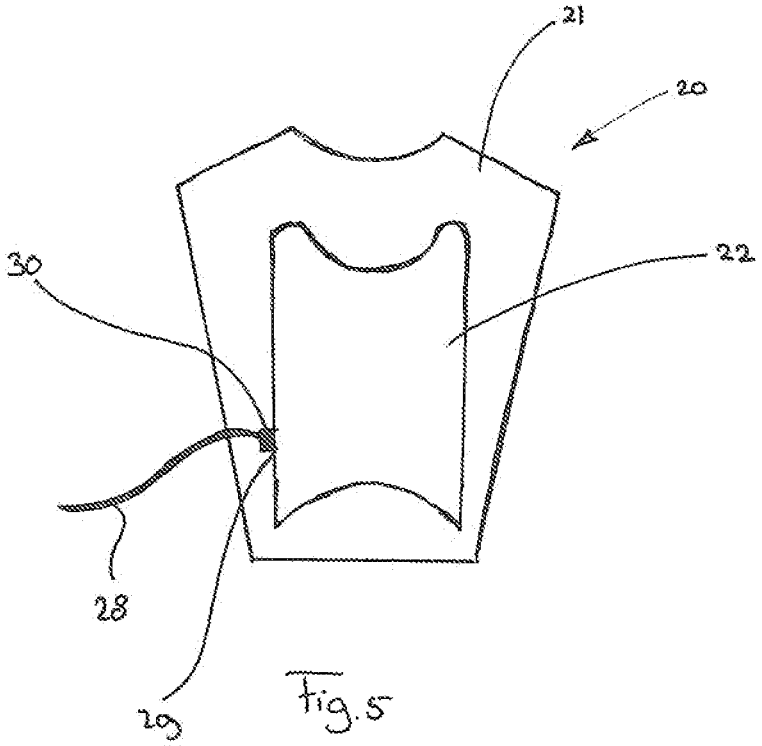
FIG. 5: an embodiment of a chest positioner assembly according to the assembly, seen on the front side.

FIG. 4 and FIG. 5 show an embodiment of a chest positioner assembly 20 according to the invention. FIG. 4 shows the chest positioner assembly 20 as seen on the rear side and FIG. 5 shows the chest positioner assembly 20 as seen on the front side.

The chest body contact sheet 21 is provided on its rear surface with an upper adhesive zone 23. In the embodiment shown in FIG. 4, the upper adhesive zone 23 has generally the shape of a human clavicle, seen from the ventral side. This is an optional feature, which helps the person who attaches the disposable chest positioner assembly 20 to the patient to attach it at the right position onto the patient 1.

The chest body contact sheet 21 is further provided on its rear surface with a lower adhesive zone 24. In the embodiment shown in FIG. 4, the lower adhesive zone 24 has the shape that generally matches the shape of the human lower ribs when seen from the ventral side. As an alternative, the lower adhesive zone could have the shape of a straight line.

The distance between the upper adhesive zone 23 and the lower adhesive zone 24 is such that it generally matches the size of the human chest, so that the upper adhesive zone 23 can be attached to the skin of a patient in the vicinity of the clavicle and the lower adhesive zone 24 can be attached to the skin of a patient in the vicinity of the lower ribs without folds or creases in the chest body contact sheet 21.

The chest body contact sheet 21 is in this embodiment further provided on its rear surface with a central adhesive zone 25. This central adhesive zone 25 has a shape that generally corresponds to the shape of a human breastbone or a part thereof as seen from the ventral side. The central adhesive zone 25 preferably is attached to the skin of a patient in the vicinity of the breastbone.

In the embodiment of FIG. 4, the chest body contact sheet 21 is optionally further provided on its rear surface with a left adhesive zone 26 and a right adhesive zone 27.

In the embodiment of FIG. 4, optionally the adhesive zones 23, 24, 25, 26, 27 of the chest body contact sheet 21 are connected to each other. Together, they form an adhesive area into which the adhesive zones 23, 24, 25, 26, 27 are integrated.

The central adhesive zone 25 facilitates proper positioning of the disposable chest positioner assembly 20 onto the chest of the patient 1. In a specific embodiment of the method according to the invention, the central adhesive zoned 25 is attached to the skin of the patient before the upper adhesive zone 23 and the lower adhesive zone 24 of the disposable chest positioner assembly 20 are attached to the patient. The breastbone of the patient provided as clear anatomical landmark that can be used to position the of the disposable chest positioner assembly 20 onto the chest of the patient 1.

By first attaching the central adhesive zone 25 onto the chest of the patient, and then folding the chest positioner assembly outwardly to the left and the right, and then attaching the upper adhesive zone 23 and the lower adhesive zone 24 to the patient 1, e.g. first on the right side and then on the left side or the other way around, an efficient and accurate way of attaching the disposable chest positioner assembly 20 onto the chest of the patient is obtained.

FIG. 5 shows the chest positioner assembly 20 as seen on the front side. FIG. 5 shows the inflatable chest cushion 22 which is permanently attached to the front surface of chest body contact sheet 21. The inflatable chest cushion 22 does not extend over the abdominal region 2 of the patient 1 when the chest positioner assembly 20 is attached to the patient. The inflatable chest cushion 22 is arranged between the upper adhesive zone 23 and the lower adhesive zone 24.

In the embodiment of FIG. 4 and FIG. 5, the lower edge of the inflatable chest cushion 22 has a shape that generally matches the shape of the lower ribs of a human as seen from the ventral side. The inflatable chest cushion 22 in its inflated state does not extend over the abdominal region of the patient.

In the embodiment of FIG. 4 and FIG. 5, the upper edge of the inflatable chest cushion 22 also has a curved shape. This creates space for the head for the situation wherein hyperflexion of the cervical spine is required.

In the embodiment of FIG. 4 and FIG. 5, the inflatable chest cushion 22 is provided with a flexible air hose 28. The flexible air hose 28 is connected to the chest cushion 22 at an air supply location 29. The air supply location is 29 is arranged on the lateral side of the chest cushion 22 in the inflated state, as can be seen in FIG. 3 as well. The "lateral side" in this embodiment is the peripheral wall of the chest cushion 22, that extends substantially perpendicular to the chest of the patient when the chest cushion is inflated.

In the embodiment of FIG. 4 and FIG. 5, the inflatable chest cushion 22 is provided with a check valve 30, that prevents undesired deflation of the chest cushion 22. The check valve 30 is also arranged on the lateral side of the chest cushion 22 in the inflated state.

Figure 6:
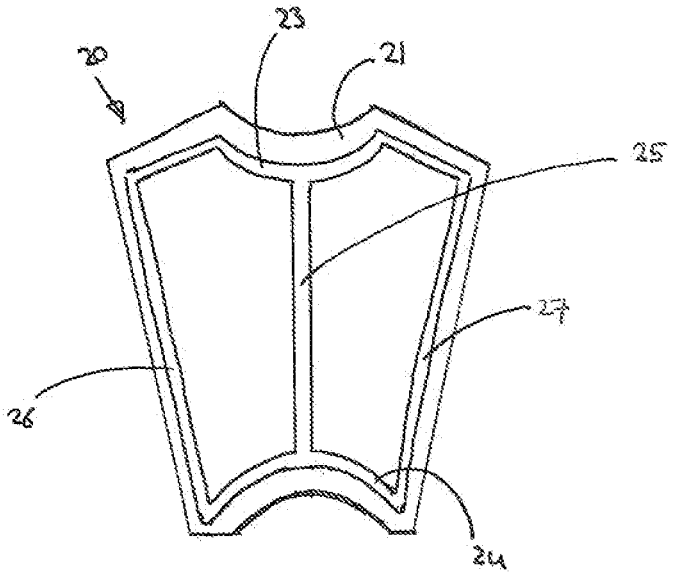
FIG. 6: a second embodiment of a disposable chest positioner assembly according to the invention, seen on the rear side.
Figure 7:
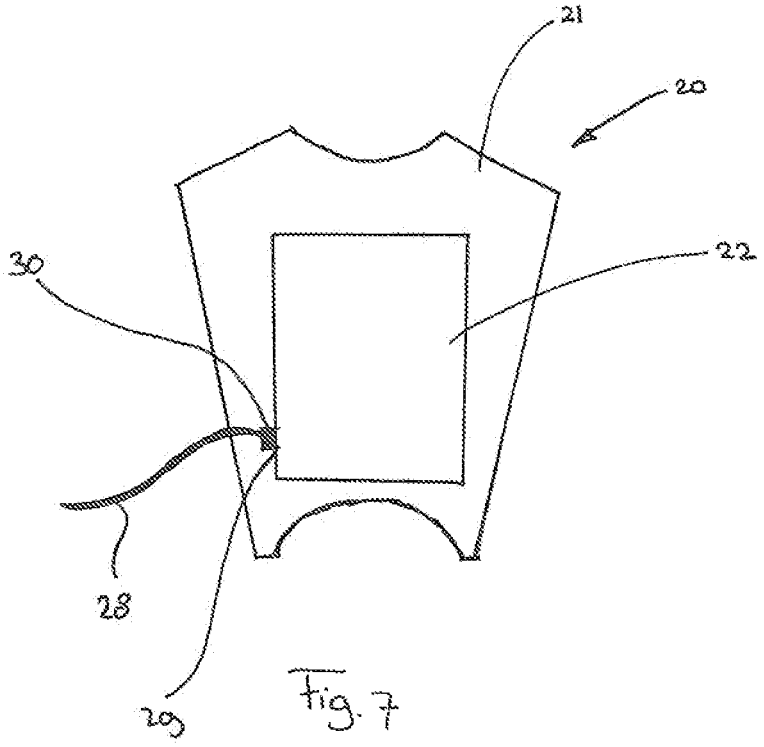
FIG. 7: a second embodiment of the disposable chest positioner assembly according to the invention, seen on the front side.

FIG. 6 and FIG. 7 show a second embodiment of the disposable chest positioner assembly according to the invention. FIG. 6 shows the rear side of the chest positioner assembly and FIG. 7 shows the front side of the chest positioner assembly.

In this embodiment, the chest positioner assembly is similar to the chest positioner assembly shown in FIG. 4 and FIG. 5. However, the chest cushion 22 has a more or less rectangular shape, while the lower edge and the lower adhesive zone 24 have a shape that generally matches the shape of the lower ribs of a human when seen from the ventral side. Also in this embodiment, the chest cushion in its inflated state does not extend over the abdominal region of the patient.

Figure 8:
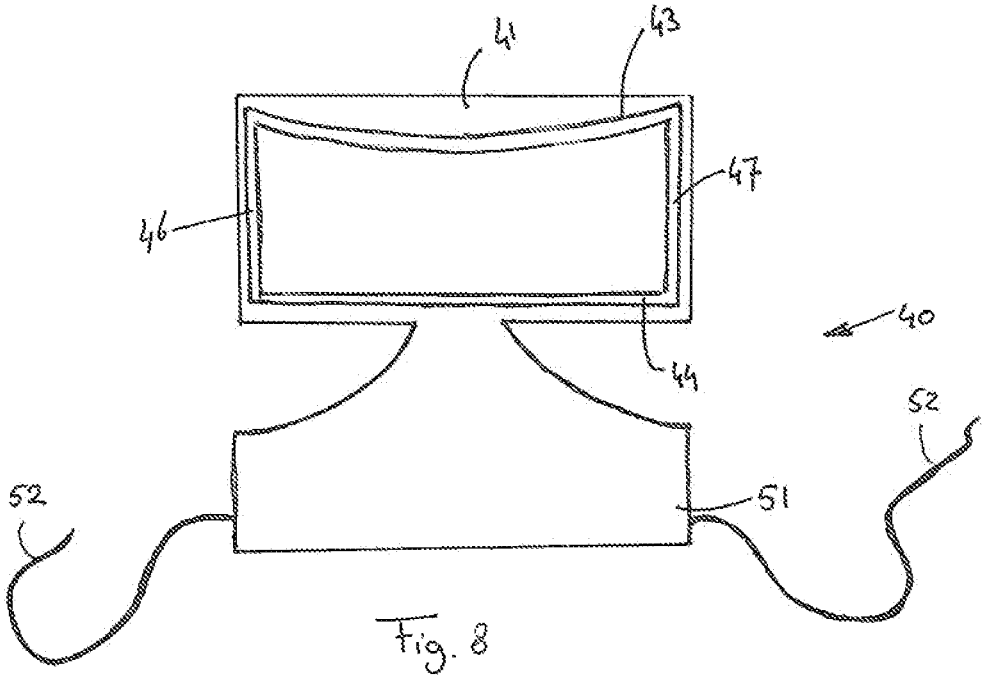
FIG. 8: an embodiment of a pelvis positioner assembly according to the assembly, seen on the rear side.
Figure 9:
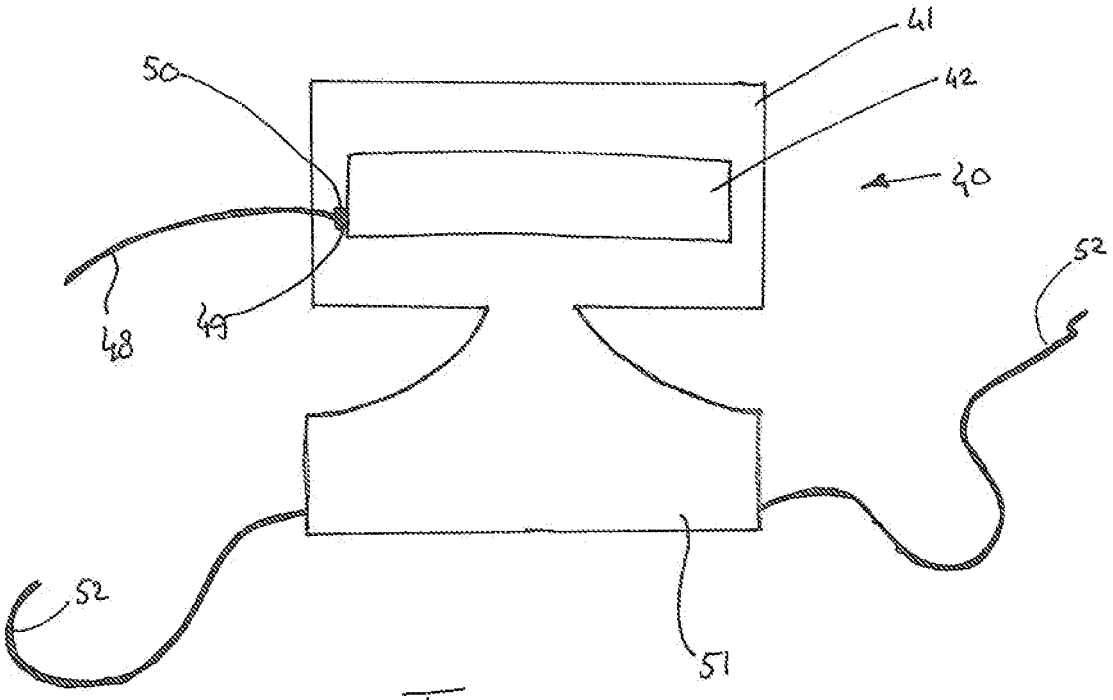
FIG. 9: an embodiment of a pelvis positioner assembly according to the assembly, seen on the front side.

FIG. 8 and FIG. 9 show an embodiment of a pelvis positioner assembly 40 according to the invention. FIG. 8 shows the pelvis positioner assembly 40 as seen on the rear side and FIG. 9 shows the pelvis positioner assembly 40 as seen on the front side.

The pelvis body contact sheet 41 is provided on its rear surface with an upper adhesive zone 43. In the embodiment shown in FIG. 8, the upper adhesive zone 43 has generally the shape of the lower edge of the human abdomen, seen from the ventral side. This is an optional feature, which helps the person who attaches the disposable pelvis positioner assembly 40 to the patient to attach it at the right position onto the patient 1.

The pelvis body contact sheet 41 is further provided on its rear surface with a lower adhesive zone 44. In the embodiment shown in FIG. 8, the lower adhesive zone 44 has the shape of a straight line, but as an alternative it could have a shape that generally matches the shape of the human inguinal region when seen from the ventral side.

The distance between the upper adhesive zone 43 and the lower adhesive zone 44 is such that it generally matches the size of the human pelvis, so that the upper adhesive zone 43 can be attached to the skin of a patient below but adjacent to the lower edge of the abdomen and the lower adhesive zone 44 can be attached to the skin of a patient just above the inguinal region without folds or creases in the pelvis body contact sheet 41.

In the embodiment of FIG. 8, the pelvis body contact sheet 41 is optionally further provided on its rear surface with a left adhesive zone 46 and a right adhesive zone 47.

In the embodiment of FIG. 8, optionally the adhesive zones 43, 44, 46, 47 of the pelvis body contact sheet 41 are connected to each other. Together, they form an adhesive area into which the adhesive zones 43, 44, 46, 47 are integrated.

In the embodiment of FIG. 8 and FIG. 9, the pelvis positioner assembly 40 is provided with a non-inflatable genital region covering flap 51. The non-inflatable genital region covering flap 51 has a shape that—when the disposable pelvis positioner assembly 40 is attached to a patient—extends over the genital region of the patient 1. This can also be seen in FIG. 3.

The optional non-inflatable genital region covering flap 51 is provided with attachment members 52 that are adapted to attach the genital region covering flap 51 to the upper legs of the patient 1. The attachment members can for example be cords or ribbons, optionally provided with a hook and loop fastener (for example a hook and loop fastener sold under the VELCRO® brand).

FIG. 9 shows the pelvis positioner assembly 40 as seen on the front side. FIG. 9 shows the inflatable pelvis cushion 42 which is permanently attached to the front surface of pelvis body contact sheet 41. The inflatable pelvis cushion 42 does not extend over the abdominal region 2 of the patient 1 when the pelvis positioner assembly 40 is attached to the patient. The inflatable pelvis cushion 42 is arranged between the upper adhesive zone 43 and the lower adhesive zone 44.

In the embodiment of FIG. 8 and FIG. 9, the inflatable pelvis cushion 42 is provided with a flexible air hose 48. The flexible air hose 48 is connected to the pelvis cushion 42 at an air supply location 49. The air supply location is 49 is arranged on the lateral side of the pelvis cushion 42 in the inflated state, as can be seen in FIG. 3 as well. The "lateral side" in this embodiment is the peripheral wall of the pelvis cushion 42, that extends substantially perpendicular to the pelvis of the patient when the pelvis cushion is inflated.

In the embodiment of FIG. 8 and FIG. 9, the inflatable pelvis cushion 42 is provided with a check valve 50, that prevents undesired deflation of the pelvis cushion 42. The check valve 50 is also arranged on the lateral side of the pelvis cushion 42 in the inflated state.

Figure 10:
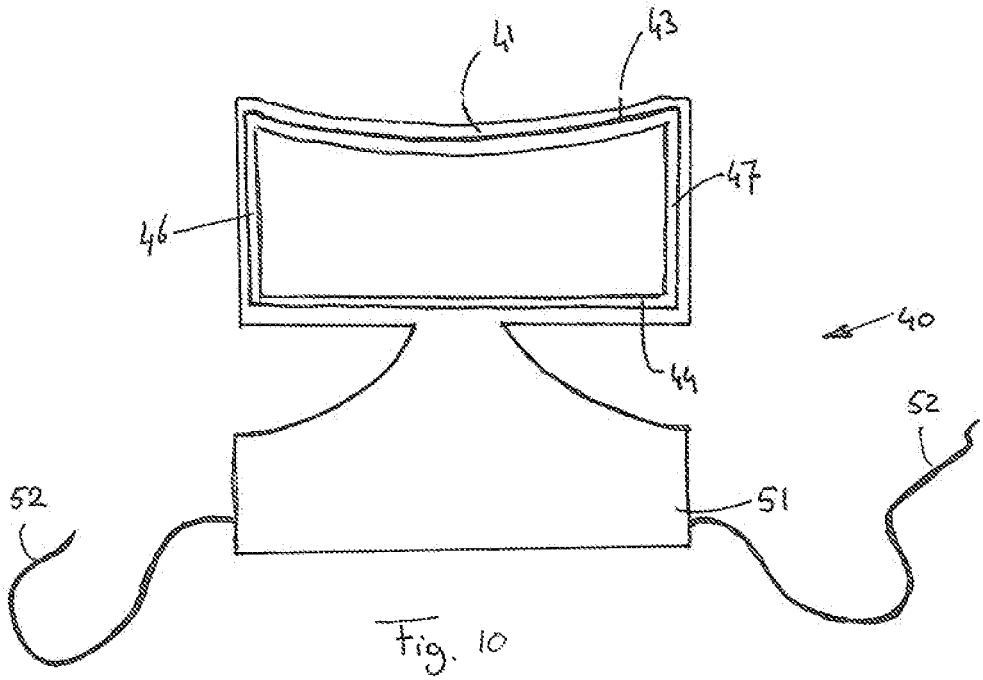
FIG. 10: a second embodiment of a disposable pelvis positioner assembly according to the invention, seen on the rear side.
Figure 11:
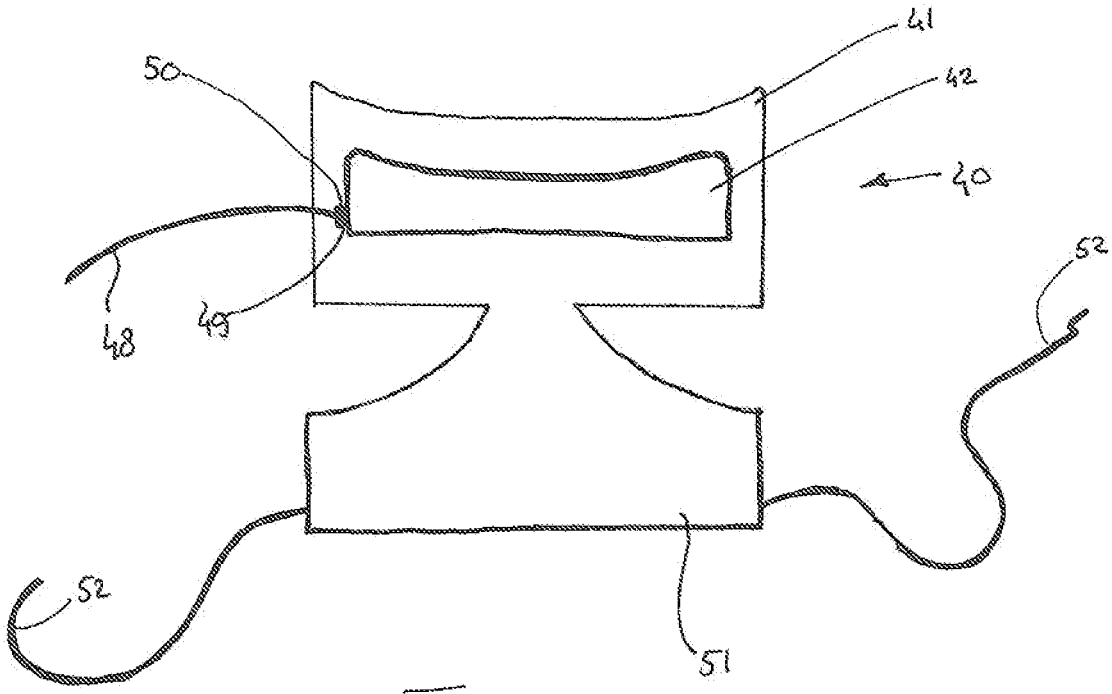
FIG. 11: a second embodiment of the disposable pelvis positioner assembly according to the invention, seen on the front side.

FIG. 10 and FIG. 11 show a second embodiment of the disposable pelvis positioner assembly according to the invention. FIG. 10 shows the rear side of the pelvis positioner assembly and FIG. 11 shows the front side of the pelvis positioner assembly.

In this embodiment, the pelvis positioner assembly is similar to the pelvis positioner assembly shown in FIG. 8 and FIG. 9. However, in this embodiment upper edge of the pelvic body contact sheet and the upper edge of the pelvis cushion in this inflated state have a shape the generally matches the lower edge of the abdomen.

Figure 12:
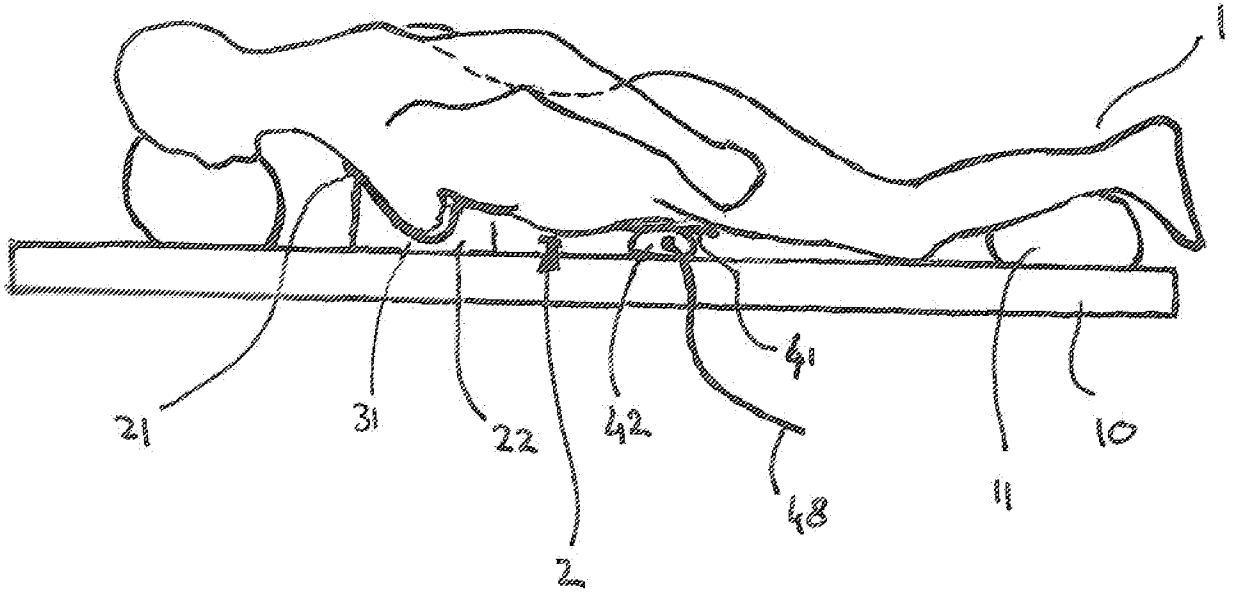
FIG. 12: a female patient being positioned by a second embodiment of the patient positioner system according to the invention.

FIG. 12 shows a female patient 1 being positioned by a second embodiment of the patient positioner system according to the invention.

This second embodiment is generally the same as the embodiment as described above, but now the chest body contact sheet 21 is provided with a pocket 31 for accommodating the breasts of the patient.

Furthermore, in this second embodiment, the disposable pelvis positioner assembly 40 is not provided with the optional genital region covering flap.

Figure 13:
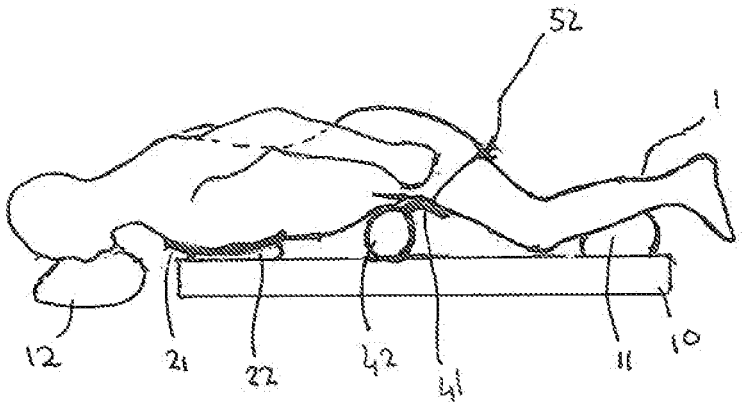
FIG. 13: a patient in jackknife position, supported by a patient positioner system according to the invention.

FIG. 13 shows a patient in jackknife position, supported by a patient positioner system according to the invention.

In the embodiment of the invention shown in FIG. 13, the inflated pelvis cushion positions the hips of the patient above the head and above the legs of the patient. The difference in height between the head and hip of the patient and/or the difference in height between the legs and hip of the patient may in practice be less than what is shown in FIG. 13.

Figure 14:
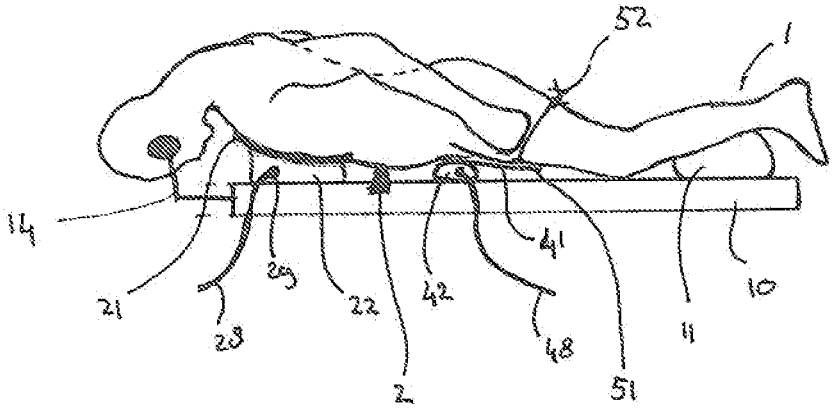
FIG. 14: a patient in a position with hyperflexion of the cervical spine, supported by a patient positioner system according to the invention.

FIG. 14 shows a patient in a position with hyperflexion of the cervical spine, supported by a patient positioner system according to the invention. A head clamp 14 fixes the position of the head of the patient.

In the embodiment of FIG. 14, the shape of the chest positioner assembly, and in particular of the chest cushion, allows the required bending of the neck by leaving room for the head of the patient.

FIG. 15-19 show a further example of an embodiment of a patient positioner system in accordance with the invention.

Figure 15:
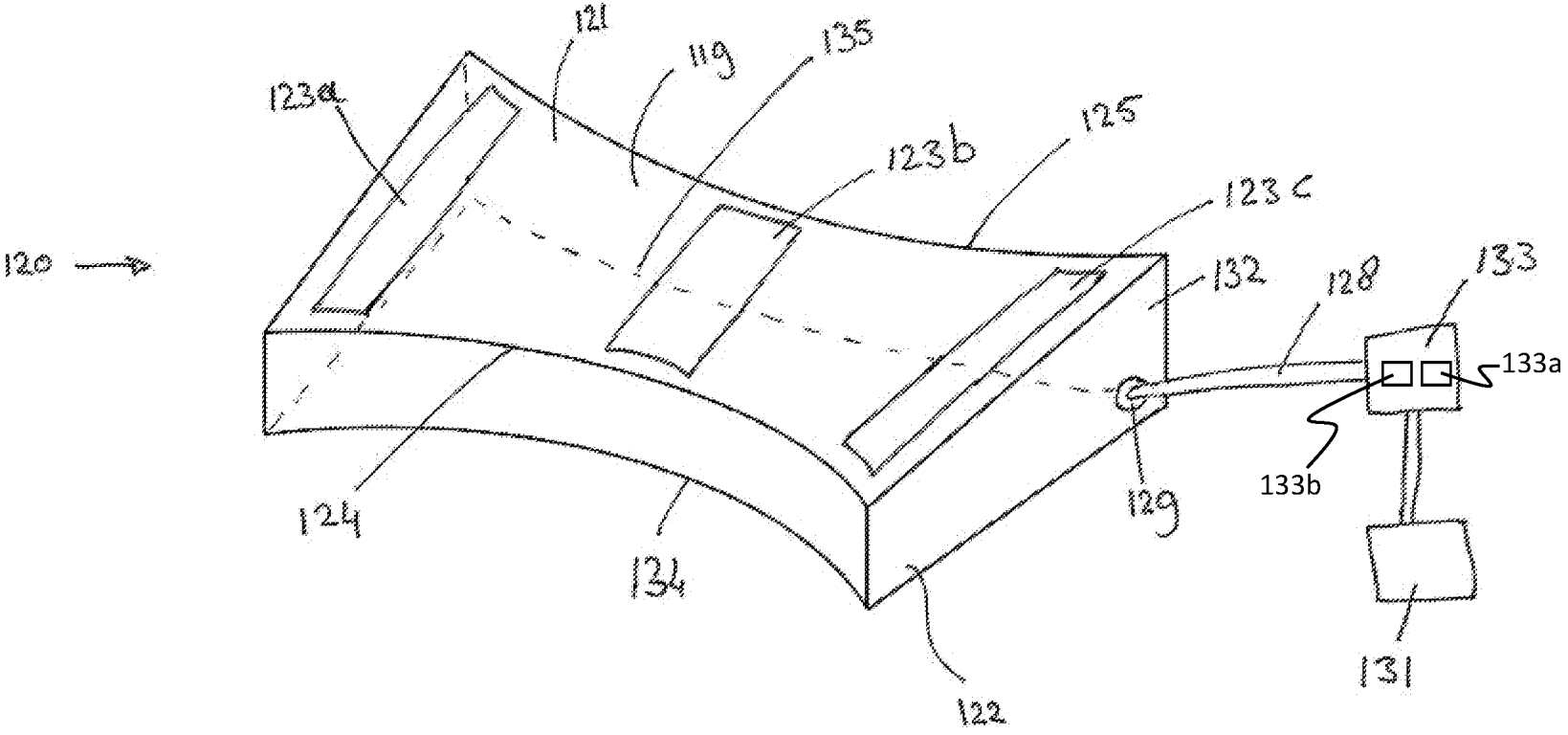
FIG. 15-19: a further example of an embodiment of a patient positioner system in accordance with the invention.
Figure 16:
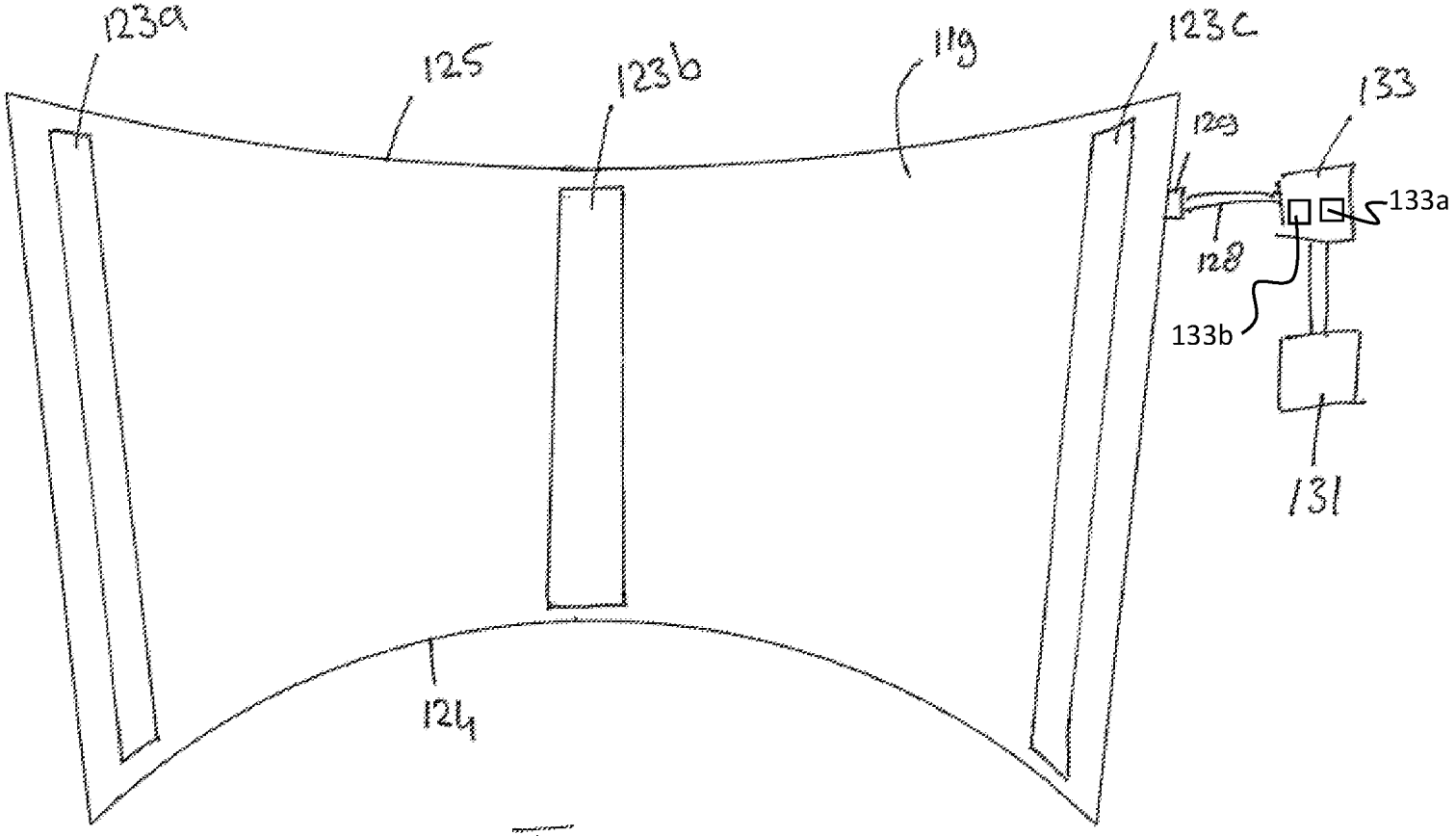
Figure 17:
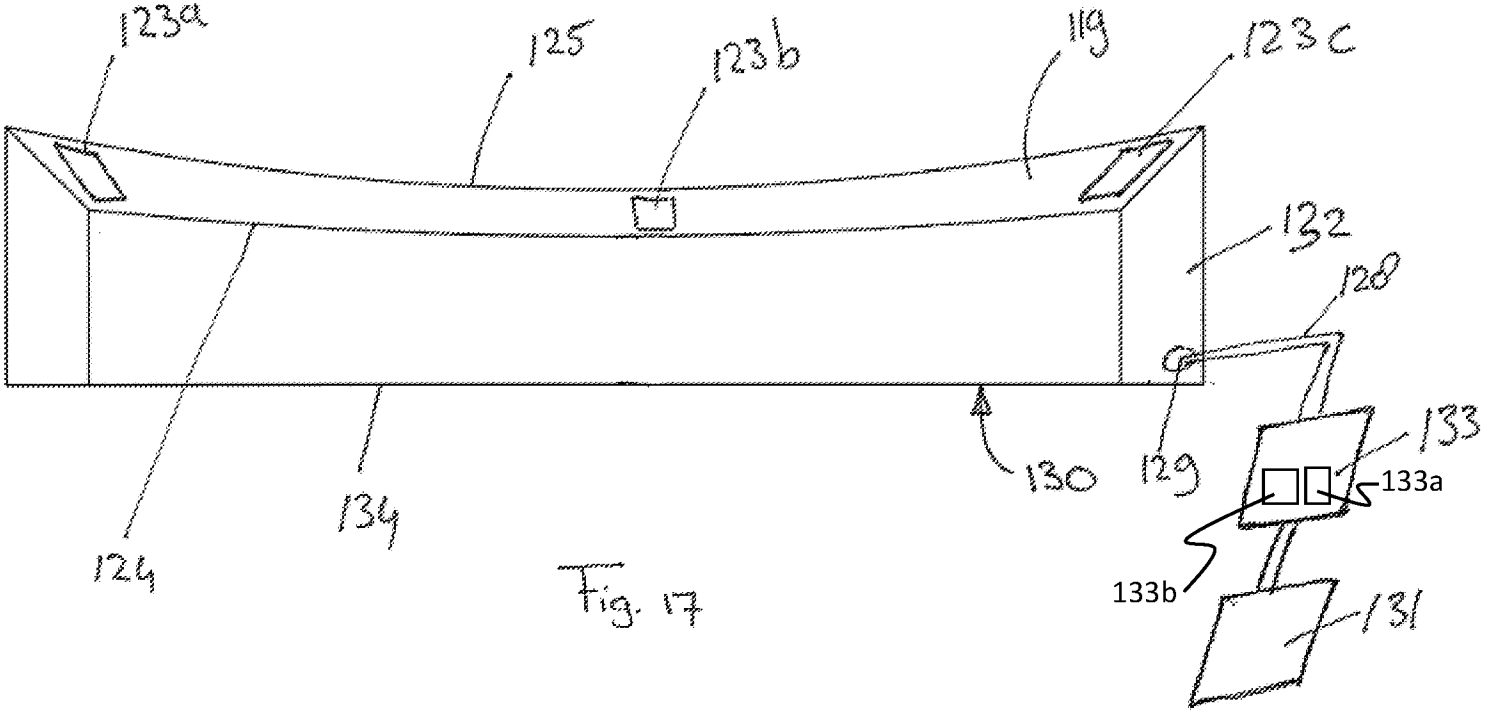

FIG. 15 schematically illustrates the chest cushion 122 of this further embodiment in its inflated state, in perspective. FIG. 16 shows the chest cushion in accordance with FIG. 15, seen from the rear. FIG. 17 also shows this chest cushion in accordance with FIG. 15, but now from the abdominal side, looking towards the neck side.

Figure 18:
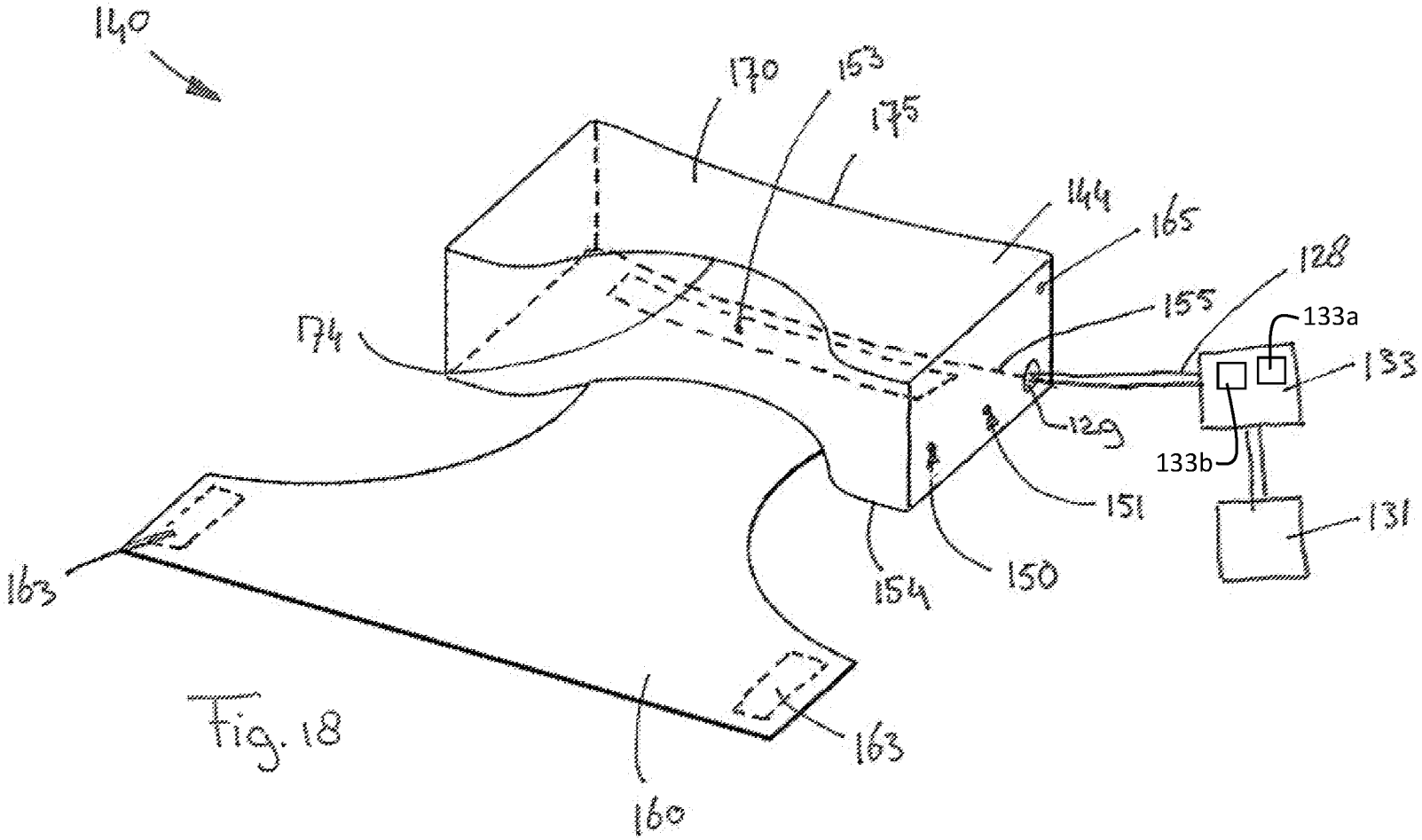
Figure 19:
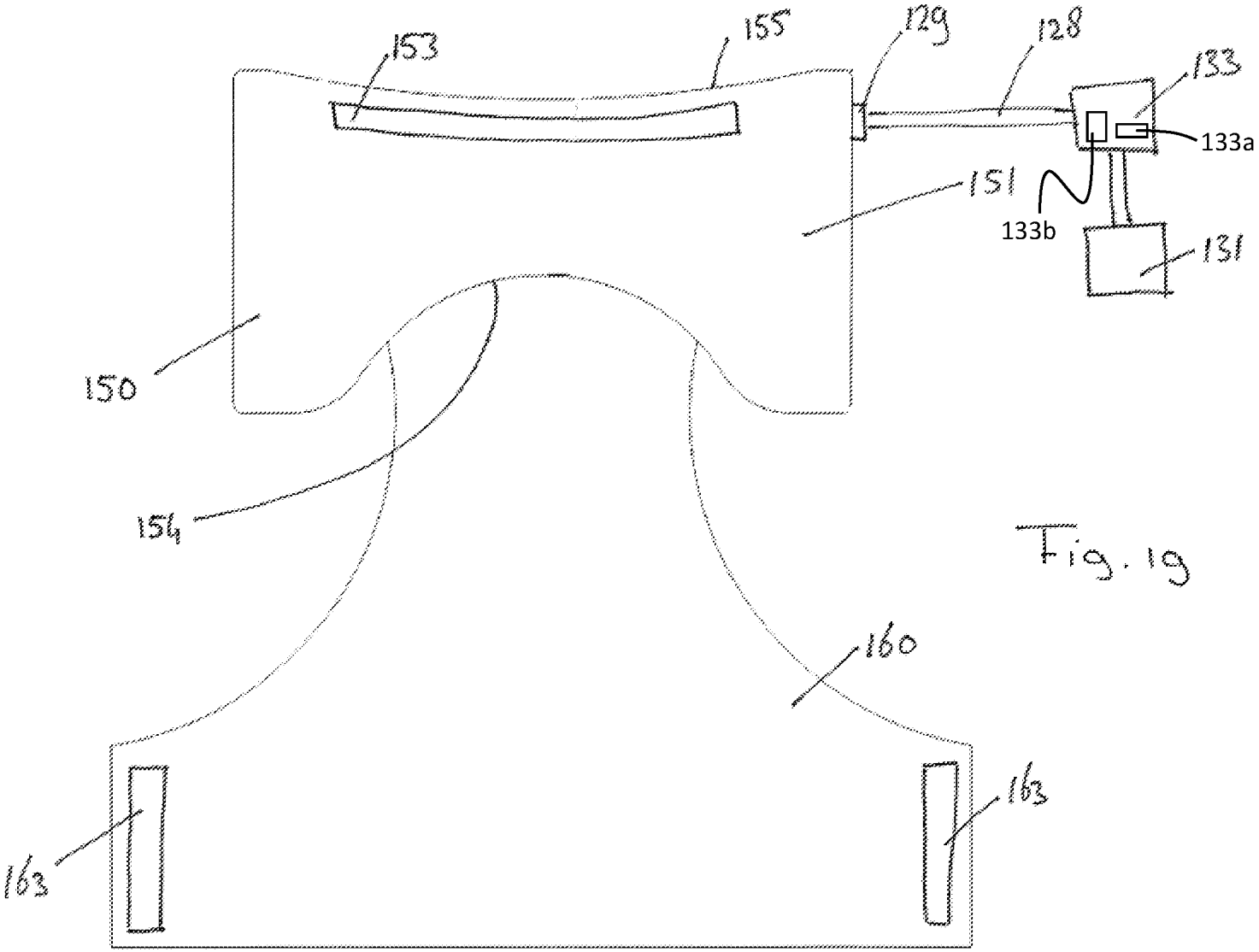

FIG. 18 schematically illustrates the pelvis cushion 144 of this further embodiment in its inflated state, in perspective. FIG. 19 shows this pelvis cushion in accordance with FIG. 18, seen from the rear.

The chest cushion that is shown in fig., FIG. 16 and FIG. 17 belongs to a chest positioner assembly 120. The chest cushion 122 is disposable, which means that it is intended for single use.

The chest cushion 122 comprises a rear wall 119. The rear wall 119 comprises a chest body contact sheet 121, which forms part of the outer surface of the chest cushion 122 and contacts the skin of the patient during use.

In this embodiment, the chest cushion has three adhesive strips 123*a*, 123*b*, 123*c* which are present on chest body contact sheet 121 on the rear wall 119 of the chest cushion 122. These adhesive strips 123*a*, 123*b*, 123*c* allow the chest cushion to be attached to the patient's chest area.

Adhesive strip 123*b* is located at the center of the rear wall 119, and has a shape that generally corresponds to the shape of a human breastbone or a part thereof as seen from the ventral side. The adhesive strip 123*b* is adapted to be attached to the skin of a patient in the vicinity of the breastbone. Therewith, the adhesive strip 123*b* is a central adhesive zone.

The rear wall 119 of the chest cushion has a neck side end 125 and an abdominal side edge 124.

The neck side edge 125 and abdominal side edge 124 both have a concave shape with a radius of curvature. The radius of curvature of the neck side edge 125 of the rear wall 119 is larger than the radius of curvature of the abdominal side edge 124 of the rear wall 119.

The distance between the neck side edge 125 and the abdominal side edge 124 of the rear wall 119 at the center of the chest cushion 122, so generally at the location of the adhesive strip 123*b*, is substantially equal to the length of a human breast bone.

As can be seen in FIG. 15, FIG. 16 and FIG. 17, the rear wall 119 and the front wall 130 of the chest cushion 122 are wider at the neck side end than at the abdominal side end.

The parts of the adhesive strips 123*a*, 123*b*, 123*c* near the neck side edge 125 of the rear wall 119 together form an upper adhesive zone. The parts of the adhesive strips 123*a*, 123*b*, 123*c* near the abdominal side edge 124 of the rear wall 119 together form a lower adhesive zone.

In the embodiment shown in FIG. 15-19, the chest cushion further comprises a front wall 130. In use, the front wall 130 engages the patient support, which is e.g. an operation table.

The front wall 130 of the chest cushion has a neck side end 1135 and an abdominal side edge 134.

The neck side edge 135 and abdominal side edge 134 both have a concave shape with a radius of curvature. The radius of curvature of the neck side edge 135 of the front wall 130 is larger than the radius of curvature of the abdominal side edge 134 of the front wall 130.

The distance between the neck side edge 135 and the abdominal side edge 134 of the front wall 130 at the center of the chest cushion 122, is substantially equal to the length of a human breast bone.

As can be seen in FIG. 17, in this particular embodiment, in the inflated state the chest cushion 122 has a larger thickness on the neck side end than at the abdominal side end.

Also, in this particular embodiment, the rear wall 119 of the chest cushion 122 has a hollow shape, to match the generally convex shape of the human chest.

In the embodiment of FIG. 15-19, the inflatable chest cushion 22 is provided with a flexible air hose 128. The flexible air hose 128 is connected to the chest cushion 122 at an air supply location 129. The air supply location 129 is arranged on the lateral side of the chest cushion 122 in the inflated state, as can be seen in FIG. 15. The "lateral side" in this embodiment is the peripheral wall 132 of the chest cushion 122, that extends between the front wall 130 and the rear wall 119.

The air hose 128 is connected to a source 131 of pressurized air.

In the embodiment of FIG. 15-19, the inflatable chest cushion 122 is provided with a valve assembly 133 comprises a check valve, a pressure relief valve 133*a* and a safety relief valve 133*b*. The check valve, pressure relief valve 133*a* and safety relief valve 133*b* are arranged in a common valve housing. Optionally, the pressure relief valve 133*a* is a manually operable pressure relief valve which requires the use of two hands for actuation.

FIG. 18 and FIG. 19 schematically illustrate the pelvis cushion 144 of the disposable pelvis positioner assembly 140 of the embodiment of FIG. 15-19 in its inflated state.

The pelvis cushion 144 comprises a rear wall 150,

The rear wall of the pelvis cushion comprises a pelvic body contact sheet 151 which is made of a soft material. The pelvic body contact sheet 151 has a rear surface which forms part of the outer surface of the pelvis cushion 144.

The pelvic body contact sheet 151 is on the rear surface provided with at least one adhesive zone, here in the form of adhesive strip 153, which adhesive strip 153 is adapted to be attached to the skin of a patient in the pelvis area.

The disposable inflatable pelvis cushion 144 has a deflated state and an inflated state.

The rear wall 150 of the pelvis cushion 144 has an abdominal side edge 155 and a genital side edge 154. The abdominal side edge 155 and genital side edge 154 have a concave shape having a radius of curvature, wherein the radius of curvature of the abdominal side edge 155 of the rear wall 150 is larger than the radius of curvature of the genital side edge 154 of the rear wall 150. This can be clearly seen in FIG. 19.

The distance between the abdominal side edge 155 and the genital side edge 154 of the rear wall 150 at the center of the pelvis cushion 144 is substantially equal to the distance between the lower edge of the abdomen and the upper edge of the exterior genitals in a human.

In the embodiment of FIG. 15-19, the pelvis cushion 144 further comprises a front wall 170, which is located opposite the rear wall 150.

In the inflated state, the front wall 170 of the pelvis cushion has an abdominal side edge 175 and a genital side edge 174. The abdominal side edge 175 and genital side edge 174 have a concave shape having a radius of curvature. The radius of curvature of the abdominal side edge 175 of the front wall 170 is larger than the radius of curvature of the genital side edge 174 of the front wall 170.

In this embodiment, the distance between the abdominal side edge 175 and the genital side edge 174 of the front wall 170 at the center of the pelvis cushion 144 is substantially equal to the distance between the lower edge of the abdomen and the upper edge of the exterior genitals in a human.

In the embodiment of FIG. 15-19, the pelvis positioner assembly 140, is provided with a non-inflatable genital region covering flap 160. The non-inflatable genital region covering flap 160 has a shape that—when the disposable pelvis positioner assembly 140 is attached to a patient—extends over the genital region of the patient.

The optional non-inflatable genital region covering flap 160 is in this example provided with adhesive strips 163 for attaching the non-inflatable genital region covering flap 160 to the upper legs of the patient.

In the embodiment shown, the non-inflatable genital region covering flap 160 is part of the pelvic body contact sheet 151 that extends beyond the rear wall 150 of the pelvis cushion 144.

In the embodiment of FIG. 15-19, the inflatable pelvis cushion 144 is provided with a flexible air hose 128. The flexible air hose 128 is connected to the pelvis cushion 144 at an air supply location 129. The air supply location 129 is arranged on the lateral side of the pelvis cushion 144 in the inflated state, as can be seen in FIG. 15. The "lateral side" in this embodiment is the peripheral wall 165 of the pelvis cushion 144, that extends between the front wall 170 and the rear wall 150.

The air hose 128 is connected to a source 131 of pressurized air.

In the embodiment of FIG. 15-19, the inflatable pelvis cushion 144 is provided with a valve assembly 133 comprises a check valve, a pressure relief valve 133*a* and a safety relief valve 133*b*. The check valve, pressure relief valve 133*a* and safety relief valve 133*b* are arranged in a common valve housing. Optionally, the pressure relief valve 133*a* is a manually operable pressure relief valve which requires the use of two hands for actuation.

The inflatable chest cushion 122 and the inflatable pelvis cushion 144 are adapted to in their inflated state together support the torso of the patient on the patient support structure. The shape of the inflatable chest cushion 122 and the inflatable pelvis cushion 144 in their inflated state allows to leave the abdominal region of the patient decompressed. The shape of the inflatable chest cushion 122 and the inflatable pelvis cushion 144 in general prevents incorrect application of these cushions 122, 144 to the patient's body, as the shape of the cushions matches the shape of the patient's body. Furthermore, anatomical landmarks of the patient's body (e.g. the breastbone or clavicle) can be used for accurately positioning the cushions 122, 144 onto the patient.

Figure 20:
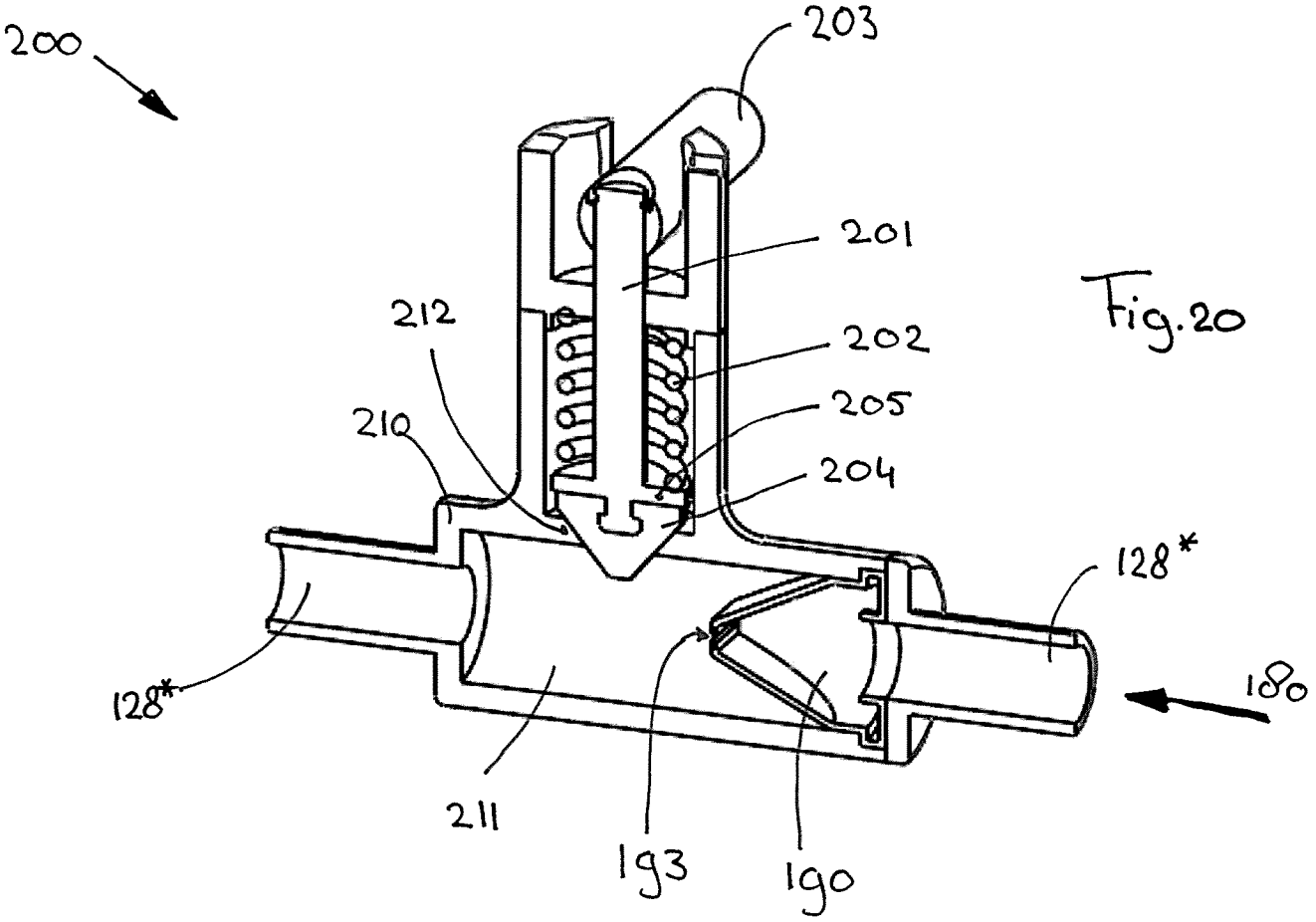
FIG. 20: an example of a valve assembly that can be used in combination with a chest cushion and/or pelvis cushion in accordance with the invention, or with any other inflatable cushion for patient positioning during diagnosis, treatment or surgery.
Figure 21:
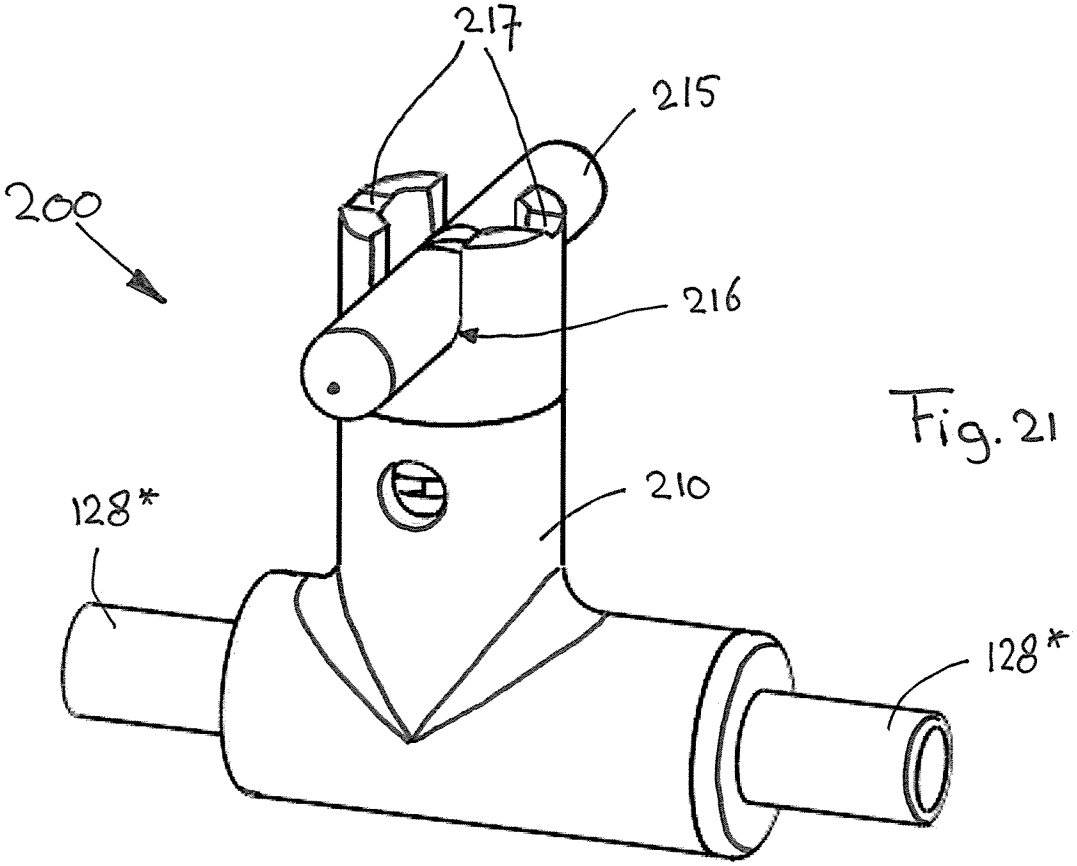
FIG. 21: a variant of the valve assembly according to FIG. 20.

FIG. 20 and FIG. 21 show examples of a valve assembly 200 that can be used in combination with a chest cushion 22, 122 and/or pelvis cushion 44, 144 in accordance with the invention, or with any other inflatable cushion for patient positioning during diagnosis, treatment or surgery.

The valve assembly 200 comprises a housing 210, a chamber 211 and two connectors 128* to which a flexible air hose 128 for compressed air or other supply hose for the pressurized medium that is used for inflating the inflatable cushion can be connected.

Arrow 180 shows the direction of the flow of air or other pressurized medium normally flows when the cushion is being brought into the inflated state. So, arrow 180 shows indicates the air or other pressurized medium flowing away from a source of pressurized fluid (e.g. air) and towards the inflatable cushion.

The valve assembly 200 comprises a check valve 190. The check valve 190 blocks a fluid flow coming from the inflatable cushion to the source of pressurized fluid, so in the direction opposite to arrow 180. A fluid flow coming from the source of pressurized fluid will open the slit 193, allowing further flow into chamber 211. A fluid flow coming from the cushion will close the slit 193 and will thus block any flow back into the source of pressurized fluid. This design is known as a duck-bill valve. As an alternative for a duck bill valve, a check valve with a moveable check valve body, e.g. a ball check valve, may be used.

The valve assembly further comprises a pressure relief valve and a safety relief valve, which are integrated in the example of FIG. 20. In this embodiment, the pressure relief valve is adapted to be operated manually.

A seal body 204 is mounted onto operating rod 201. The operating rod 201 has a shoulder 205. A compression spring 202 is provided between the housing 210 and the shoulder 205 of the operating rod 201. In addition, an actuator element 203, in the example of FIG. 20 a rotatable rod, is provided which is connected to the operating rod 201. As an alternative for the rotatable rod, a rotatable knob may be used.

In normal operation, the seal body 204 is arranged in a seat 212 in the housing 210. In this situation, the seal body 204 closes the opening in the seat 212.

Pressure can be released form the cushion by making the seal body 204 move away from the seat 212. This allows the pressurized medium, e.g. pressurized air, to escape from the chamber 211 through the opening in seat 212.

The seal body 204 can be moved away from the seat 212 by a user, in particular somebody of the medical team, who turns and/or pulls the actuator element 203 in such a direction that the seal body 204 is moved away from the seat 212. This will for example be done when the medical team decides that the cushion has been over-inflated, making the cushion too hard for the patient to comfortably lie on. When sufficient pressure has been released, the user releases the actuator element 203 and/or moves it in the opposite direction so that the seal body 204 comes to lie in the seat 212 again, e.g due to the action of the compression spring 202, and no pressurized medium can escape from the chamber 211 via the seat 212 any more.

In the case of excessive pressure in the cushion, at an unsafe level, the seal body 204 will press onto the shoulder 205 and away from the seat 212, in turn compressing the spring 202. The excessive pressure will then be released through seat 212. When a safe level of pressure has been attained again, the force of the spring will repress seal body 204 into seat 212. Herewith, the valve assembly fulfills the function of a safety relief valve. No operation of the actuator element 203 is necessary to release the pressure in this case in order to obtain a safe level of pressure in the cushion again.

Optionally, in this embodiment, moving the actuator element 203 requires so much force or involves such a complex movement (e.g. a combination of pulling and turning) that a user will need to hold the housing 210 in one hand and operate the actuator element 203 (e.g. by pulling and/or turning) using the other hand. This helps to avoid that pressure is released unintentionally.

Optionally, the force of the compression spring 202 is selected depending on the size of the cushion, so that for cushions intended for heavy patients, the spring is stronger than for cushions which are intended for lighter patients.

FIG. 21 shows a variant of the valve assembly 200.

During normal operation, the rod 215 is arranged in rod seat 216. In order to operate the seal body 204 to release some pressure from the cushion, the rod 215 needs to be lifted from its rod seat 216. For complete deflation of the cushion, the rod 215 can be lifted out of seat 216 and rotated into seat 217 which locks the seal body 204 away from seat 212.

One or both of these movements of the rod 215 optionally require the simultaneous use of two hands of the person operating the valve assembly (e.g. one hand holding and moving the rod 215 and one hand holding the valve housing 210), and therewith it helps to avoid that pressure is released unintentionally.

In the embodiment of FIG. 20 and in the embodiment of FIG. 21, optionally the common valve housing has a length (seen in the direction of normal flow of pressure medium, e.g. air, through the valve) of less than 10 centimeter, optionally less than 5 centimeter.

Clauses:

1. Method for positioning a patient in a prone position on a patient support structure, which method comprises the following steps:
   - providing a patient positioner system, which patient positioner system comprises:
     - a disposable chest positioner assembly, which disposable chest positioner assembly comprises:
       - a chest body contact sheet which is made of a soft material, which chest body contact sheet has a front surface and a rear surface,
       - which chest body contact sheet is on the rear surface provided with an upper adhesive zone, which upper adhesive zone is adapted to be attached to the skin of a patient in the vicinity of the clavicle,
       - which chest body contact sheet is on the rear surface further provided with a lower adhesive zone, which lower adhesive zone is adapted to be attached to the skin of a patient in the vicinity of the lower ribs,
       - an inflatable chest cushion,
       - which inflatable chest cushion is permanently attached to the front surface of the chest body contact sheet between the upper adhesive zone and the lower adhesive zone,
     - wherein the inflatable chest cushion has an deflated state and an inflated state,
     - a disposable pelvis positioner assembly, which disposable pelvis positioner assembly comprises:
       - a pelvic body contact sheet which is made of a soft material, which pelvic body contact sheet has a front surface and a rear surface,
       - which pelvic body contact sheet is on the rear surface provided with an upper adhesive zone, which upper adhesive zone is adapted to be attached to the skin of a patient below but adjacent to the lower edge of the abdomen,
       - which pelvic body contact sheet is on the rear surface further provided with a lower adhesive zone, which lower adhesive zone is adapted to be attached to the skin of a patient just above the inguinal region,
       - an inflatable pelvis cushion,
       - which inflatable pelvis cushion is permanently attached to the front surface of the pelvic body contact sheet between the upper adhesive zone and the lower adhesive zone,
       - wherein the inflatable pelvis cushion has an deflated state and an inflated state,
   - positioning a patient in a supine position on the patient support structure,
   - attaching the chest body contact sheet of the disposable chest positioner assembly to the chest of the patient by attaching the upper adhesive zone of the chest body contact sheet to the skin of the patient in the vicinity of the clavicle of the patient and attaching the lower adhesive zone of the chest body contact sheet to the skin of the patient in the vicinity of the lower ribs of the patient, with the inflatable chest cushion of the disposable chest positioner assembly in the deflated state,
   - attaching the pelvic body contact sheet of the disposable pelvis positioner assembly to the pelvic region of the patient by attaching the upper adhesive zone of the pelvic body contact sheet to the skin of the patient just below the abdominal region of the patient and attaching the lower adhesive zone of the pelvic body contact sheet to the skin of the patient just above the inguinal region of the patient, with the inflatable pelvis cushion of the disposable pelvis positioner assembly in the deflated state,
   - transferring the patient from the supine position to a prone position, thereby making the patient come to lie on the patient support structure in a prone position,
   - with the chest body contact sheet attached to the chest of the patient and the pelvic body contact sheet attached to the pelvic region of the patient and the patient in the prone position, inflating the chest cushion and the pelvis cushion, thereby lifting the patient from the patient support structure by making that the chest cushion and the pelvis cushion together bear the weight of the torso of the patient while the patient is in a prone position with the abdominal region of the patient being decompressed.

2. Method according to clause 1,
   - wherein at least one of the supraclavicular region, the lateral cutaneous nerve, the vena saphena magna, the arterie femoralis, the breasts in case of a female patient, and/or the genital region of the patient is decompressed while the patient is in the prone position with the inflated pelvis cushion and the inflated chest cushion bearing the weight of the torso of said patient.

3. Method according to any of the preceding clauses,
   - wherein a patient positioner system is provided with the chest body contact sheet of the disposable chest positioner assembly being on the rear surface further provided with a central adhesive zone, which central adhesive zone has a shape that generally corresponds to the shape of a human breastbone or a part thereof as seen from the ventral side In which method the chest body contact sheet is attached to the patient by first attaching the central adhesive zone to the patient and then attaching the other adhesive zones to the patient.

4. Patient positioner system for positioning a patient in a prone position on a patient support structure,
   - which patient positioner system comprises:
     - a disposable chest positioner assembly, which disposable chest positioner assembly comprises:
       - a chest body contact sheet which is made of a soft material, which chest body contact sheet has a front surface and a rear surface,
       - which chest body contact sheet is on the rear surface provided with an upper adhesive zone, which upper adhesive zone is adapted to be attached to the skin of a patient in the vicinity of the clavicle,
       - which chest body contact sheet is on the rear surface further provided with a lower adhesive zone, which lower adhesive zone is adapted to be attached to the skin of a patient in the vicinity of the lower ribs,
       - an inflatable chest cushion,
       - which inflatable chest cushion is permanently attached to the front surface of the chest body contact sheet between the upper adhesive zone and the lower adhesive zone,
       - wherein the inflatable chest cushion has an deflated state and an inflated state, wherein the inflatable chest cushion—when the disposable chest positioner assembly is attached to a patient—in its inflated state has a shape that leaves the abdominal region of the patient decompressed, a disposable pelvis positioner assembly, which disposable pelvis positioner assembly comprises:

a pelvic body contact sheet which is made of a soft material, which pelvic body contact sheet has a front surface and a rear surface, which pelvic body contact sheet is on the rear surface provided with an upper adhesive zone which upper adhesive zone is adapted to be attached to the skin of a patient below but adjacent to the lower edge of the abdomen, which pelvic body contact sheet is on the rear surface further provided with a lower adhesive zone, which lower adhesive zone is adapted to be attached to the skin of a patient just above the inguinal region, an inflatable pelvis cushion, which inflatable pelvis cushion is permanently attached to the front surface of the pelvic body contact sheet between the upper adhesive zone and the lower adhesive zone, wherein the inflatable pelvis cushion has an deflated state and an inflated state, wherein the inflatable pelvis cushion—when the disposable pelvis positioner assembly is attached to a patient—in its inflated state has a shape that leaves the abdominal region of the patient decompressed, wherein the inflatable chest cushion and the inflatable pelvis cushion are adapted to in their inflated state together support the torso of the patient on the patient support structure while leaving the abdominal region of the patient decompressed.

5. Disposable patient positioner system for positioning a patient in a prone position on a patient support structure, which disposable patient positioner system comprises:

a disposable chest positioner assembly, which disposable chest positioner assembly comprises a disposable inflatable chest cushion, which chest cushion comprises a rear wall, wherein the rear wall of the chest cushion comprises a chest body contact sheet which is made of a soft material, which chest body contact sheet has a rear surface which forms part of the outer surface of the chest cushion, which chest body contact sheet is on the rear surface provided with at least one adhesive zone, which adhesive zone is adapted to be attached to the skin of a patient in the chest area, wherein the disposable inflatable chest cushion has a deflated state and an inflated state, wherein in the inflated state, the rear wall of the chest cushion has a neck side edge and an abdominal side edge, wherein said neck side edge and abdominal side edge have a concave shape having a radius of curvature, wherein the radius of curvature of the neck side edge of the rear wall is larger than the radius of curvature of the abdominal side edge of the rear wall, and wherein the distance between the neck side edge and the abdominal side edge of the rear wall at the center of the chest cushion is substantially equal to the length of a human breast bone, and a disposable pelvis positioner assembly, which disposable pelvis positioner assembly comprises a disposable inflatable pelvis cushion, which pelvis cushion comprises a rear wall, wherein the rear wall of the pelvis cushion comprises a pelvic body contact sheet which is made of a soft material, which pelvic body contact sheet has a rear surface which forms part of the outer surface of the pelvis cushion, which pelvic body contact sheet is on the rear surface provided with at least one adhesive zone, which adhesive zone is adapted to be attached to the skin of a patient in the pelvis area, wherein the disposable inflatable pelvis cushion has a deflated state and an inflated state, wherein in the inflated state, the rear wall of the pelvis cushion has an abdominal side edge and a genital side edge, wherein said abdominal side edge and genital side edge have a concave shape having a radius of curvature, wherein the radius of curvature of the abdominal side edge of the rear wall is larger than the radius of curvature of the genital side edge of the rear wall, and wherein the distance between the abdominal side edge and the genital side edge of the rear wall at the center of the pelvis cushion is substantially equal to the distance between the lower edge of the abdomen and the upper edge of the exterior genitals in a human, wherein the inflatable chest cushion and the inflatable pelvis cushion are adapted to in their inflated state together support the torso of the patient on the patient support structure and wherein the shape of the inflatable chest cushion and the inflatable pelvis cushion in their inflated state allows to leave the abdominal region of the patient decompressed.

6. Patient positioner system according to any of the clauses 4-5, wherein the inflatable pelvis cushion—when attached to a patient—in its inflated state has a shape that leaves the lateral cutaneous nerve, the vena saphena magna, the arterie femoralis and/or the genital region of the patient decompressed, and/or wherein the inflatable chest cushion—when attached to a patient—in its inflated state has a shape that leaves supraclavicular region of the patient decompressed.

7. Patient positioner system according to any of the clauses 4-6, wherein the adhesive zone, optionally the upper adhesive zone, of the chest body contact sheet has a shape that generally corresponds to the shape of a human clavicle or a part thereof as seen from the ventral side and/or wherein adhesive zone, optionally the upper adhesive zone of the pelvic body contact sheet has a shape that generally corresponds to the shape of the lower edge of the human abdomen.

8. Patient positioner system according to any of the clauses 4-7, wherein the chest body contact sheet of the disposable chest positioner assembly is on the rear surface further provided with a central adhesive zone, which central adhesive zone has a shape that generally corresponds to the shape of a human breastbone or a part thereof as seen from the ventral side and which central adhesive zone is adapted to be attached to the skin of a patient in the vicinity of the breastbone.

9. Patient positioner system according to any of the clauses 4-8, wherein the pelvic body contact sheet, comprises a non-inflatable genital region covering flap, which non-inflatable genital region covering flap has a shape that—when the disposable pelvis positioner assembly is attached to a patient—extends over the genital region of the patient.

10. Patient positioner system according to clause 9,
wherein the non-inflatable genital region covering flap is provided with an attachment member that is adapted to attach the non-inflatable genital region covering flap to the upper leg of a patient.

11. Patient positioner system according to any of the clauses 4-10,
wherein the chest body contact sheet comprises a pocket or fold, which pocket of fold is adapted in its shape, size and position on the body contact sheet to accommodate at least one breast of a female patient when the disposable chest positioner assembly is attached to said female patient.

12. Patient positioner system according to any of the clauses 4-11,
wherein the inflatable chest cushion in its inflated state projects less from the front surface of the chest body contact sheet than the inflatable pelvis cushion in its inflated state projects from the front surface of the pelvis body contact sheet.

13. Patient positioner system according to any of the clauses 4-13,
wherein the chest cushion and/or the pelvis cushion is provided with an air supply connector or a flexible air hose, wherein the air supply connector or flexible air hose is provided at an air supply location at the chest cushion or pelvis cushion, respectively, which air supply location is located on a lateral side of the respective cushion in the inflated state.

14. Patient positioner system according to any of the clauses 4-13,
wherein the chest cushion and/or the pelvis cushion is provided with a valve assembly which comprises a check valve, a pressure relief valve and a safety relief valve, with the check valve, pressure relief valve and safety relief valve being arranged in a common valve housing, and wherein optionally, the pressure relief valve is a manually operable pressure relief valve which requires the use of two hands for actuation.

15. Patient positioner according to clause 4,
wherein the chest cushion comprises a rear wall, and
wherein in the inflated state, the rear wall of the chest cushion has a neck side edge and an abdominal side edge, wherein this neck side edge and this abdominal side edge have a concave shape having a radius of curvature, wherein the radius of curvature of the neck side edge of the rear wall is larger than the radius of curvature of the abdominal side edge of rear wall,
and wherein the rear wall of the chest cushion is wider at its neck side edge than at its abdominal side edge,
and wherein optionally the distance between the neck side edge and the abdominal side edge of the rear wall at the center of the chest cushion is substantially equal to the length of a human breast bone 16. Patient positioner according to clause 4,
wherein the pelvis cushion comprises a rear wall, and
wherein in the inflated state, the rear wall of the pelvis cushion has an abdominal side edge and a genital side edge, wherein this abdominal side edge and genital side edge have a concave shape having a radius of curvature, wherein the radius of curvature of the abdominal side edge of the rear wall is larger than the radius of curvature of the genital side edge of and the rear wall,
and wherein the distance between the abdominal side edge and the genital side edge of the rear wall at the center of the pelvis cushion is substantially equal to the distance between the lower edge of the abdomen and the upper edge of the exterior genitals in a human.

17. Patient positioner system according to any of the clauses 5 or 15,
in which the width of the chest cushion at the neck side edge is between 325 millimeter and 500 millimeter, preferably between 400 millimeter and 500 millimeter or between 325 millimeter and 435 millimeter.

18. Patient positioner system according to any of the clauses 5, 15 or 17,
in which the width of the chest cushion at the abdominal side edge is between 250 millimeter and 375 millimeter, preferably between 275 millimeter and 375 millimeter or between 250 millimeter and 350 millimeter.

19. Patient positioner system according to any of the clauses 5, 15 or 17-18,
in which the distance between the neck side edge and the abdominal side edge at the center of the chest cushion is between 200 millimeter and 375 millimeter, preferably between 250 millimeter and 375 millimeter or between 200 millimeter and 300 millimeter.

20. Patient positioner system according to any of the clauses 5, 15 or 17-19,
wherein the rear wall of the chest cushion is wider at its neck side edge than at its abdominal side edge.

21. Patient positioner system according to any of the clauses 5, 15 or 17-20,
wherein the chest cushion further comprises a front wall,
wherein in the inflated state, the front wall of the chest cushion has a neck side edge and an abdominal side edge, wherein said neck side edge and abdominal side edge have a concave shape having a radius of curvature, wherein the radius of curvature of the neck side edge of the front wall is larger than the radius of curvature of the abdominal side edge of the front wall,
and wherein the distance between the neck side edge and the abdominal side edge of the front wall at the center of the chest cushion is substantially equal to the length of a human breast bone, wherein optionally the front wall of the chest cushion is wider at its neck side edge than at its abdominal side edge.

22. Patient positioner system according to any of the clauses 5 or 16,
in which the distance between the abdominal side edge and the genital side edge at the center of the pelvis cushion is between 50 millimeter and 250 millimeter, preferably between 100 millimeter and 200 millimeter.

23. Patient positioner system according to any of the clauses 5, 16 or 22,
wherein the pelvis cushion further comprises a front wall,
wherein in the inflated state, the front wall of the pelvis cushion has an abdominal side edge and a genital side edge, wherein said abdominal side edge and genital side edge have a concave shape having a radius of curvature, wherein the radius of curvature of the abdominal side edge of the front wall is larger than the radius of curvature of the genital side edge of the front wall,
and wherein the distance between the abdominal side edge and the genital side edge of the front wall at the center of the pelvis cushion is substantially equal to the distance between the lower edge of the abdomen and the upper edge of the exterior genitals in a human.

24. Patient positioner according to clause 4,
wherein the rear surface of the chest body contact sheet forms part of the outer surface of the inflatable chest cushion.

25. Patient positioner according to clause 4, wherein the rear surface of the pelvic body contact sheet forms part of the outer surface of the inflatable pelvis cushion.

26. Method for positioning a patient in a prone position on a patient support structure, which method comprises the following steps:

providing a patient positioner system according to clause 4, positioning a patient in a supine position on the patient support structure, attaching the chest body contact sheet of the disposable chest positioner assembly to the chest of the patient by attaching the upper adhesive zone of the chest body contact sheet to the skin of a patient in the vicinity of the clavicle of the patient and attaching the lower adhesive zone of the chest body contact sheet to the skin of a patient in the vicinity of the lower ribs of the patient, with the inflatable chest cushion of the disposable chest positioner assembly in the deflated state, attaching the pelvic body contact sheet of the disposable pelvis positioner assembly to the pelvic region of the patient by attaching the upper adhesive zone of the pelvic body contact sheet to the skin of a patient just below the abdominal region of the patient and attaching the lower adhesive zone of the pelvic body contact sheet to the skin of a patient just above the inguinal region of the patient, with the inflatable pelvis cushion of the disposable pelvis positioner assembly in the deflated state, transferring the patient from the supine position to a prone position, thereby making the patient come to lie on the patient support structure in a prone position, with the chest body contact sheet attached to the chest of the patient and the pelvic body contact sheet attached to the pelvic region of the patient and the patient in the prone position, inflating the chest cushion and the pelvis cushion, thereby lifting the patient from the patient support structure by making that the chest cushion and the pelvis cushion together bear the weight of the torso of the patient while the patient is in a prone position with the abdominal region of the patient being decompressed.

27. Method for positioning a patient in a prone position on a patient support structure, which method comprises the following steps:

providing a disposable patient positioner system according to clause 5, positioning a patient in a supine position on the patient support structure, attaching the chest body contact sheet of the disposable chest positioner assembly to the chest of the patient by attaching the adhesive zone of the chest body contact sheet to the skin of the patient in the chest area, leaving the abdominal region free, with the inflatable chest cushion of the disposable chest positioner assembly in the deflated state, attaching the pelvic body contact sheet of the disposable pelvis positioner assembly to the pelvic region of the patient by attaching the adhesive zone of the pelvic body contact sheet to the skin of the patient in the pelvic region, leaving the abdominal region free, with the inflatable pelvis cushion of the disposable pelvis positioner assembly in the deflated state, transferring the patient from the supine position to a prone position, thereby making the patient come to lie on the patient support structure in a prone position, with the chest body contact sheet attached to the chest of the patient and the pelvic body contact sheet attached to the pelvic region of the patient and the patient in the prone position, inflating the chest cushion and the pelvis cushion, thereby lifting the patient from the patient support structure by making that the chest cushion and the pelvis cushion together bear the weight of the torso of the patient while the patient is in a prone position with the abdominal region of the patient being decompressed.

28. Inflatable cushion for patient positioning during diagnosis, treatment or surgery, which cushion is provided with a valve assembly which comprises a check valve, a pressure relief valve and a safety relief valve, with the check valve, pressure relief valve and safety relief valve being arranged in are arranged in a common valve housing, and wherein optionally, the pressure relief valve is a manually operable pressure relief valve which requires the use of two hands for actuation.

The invention claimed is:

1. A method for positioning a patient in a prone position on a patient support structure, which method comprises the following steps:

providing a patient positioner system, which patient positioner system comprises:

a disposable chest positioner assembly, which disposable chest positioner assembly comprises:

a chest body contact sheet which is made of a soft material, which chest body contact sheet has a front surface and a rear surface, which chest body contact sheet is on the rear surface provided with an upper adhesive zone, which upper adhesive zone is configured to be attached to skin of the patient in the vicinity of the clavicle of the patient, which chest body contact sheet is on the rear surface further provided with a lower adhesive zone, which lower adhesive zone is configured to be attached to skin of the patient in the vicinity of a lower ribs of the patient, an inflatable chest cushion, which inflatable chest cushion is permanently attached to the front surface of the chest body contact sheet between the upper adhesive zone and the lower adhesive zone, wherein the inflatable chest cushion has a deflated state and an inflated state, a disposable pelvis positioner assembly, which disposable pelvis positioner assembly comprises:

a pelvic body contact sheet which is made of a soft material, which pelvic body contact sheet has a front surface and a rear surface, which pelvic body contact sheet is on the rear surface provided with an upper adhesive zone, which upper adhesive zone is configured to be attached to skin of the patient below but adjacent to a lower edge of the abdomen of the patient, which pelvic body contact sheet is on the rear surface further provided with a lower adhesive zone, which lower adhesive zone is configured to be attached to skin of the patient just above the inguinal region of the patient, an inflatable pelvis cushion, which inflatable pelvis cushion is permanently attached to the front surface of the pelvic body contact sheet between the upper adhesive zone and the lower adhesive zone, wherein the inflatable pelvis cushion has a deflated state and an inflated state, positioning the patient in a supine position on the patient support structure, attaching the chest body contact sheet of the disposable chest positioner assembly to the chest of the patient in the supine position by attaching the upper adhesive zone of the chest body contact sheet to the skin of the patient in the vicinity of the clavicle of the patient and attaching the lower adhesive zone of the chest body contact sheet to the skin of the patient in the vicinity of the lower ribs of the patient, with the inflatable chest cushion of the disposable chest positioner assembly in the deflated state, attaching the pelvic body contact sheet of the disposable pelvis positioner assembly to the pelvic region of the patient in the supine position by attaching the upper adhesive zone of the pelvic body contact sheet to the skin of the patient just below the abdominal region of the patient and attaching the lower adhesive zone of the pelvic body contact sheet to the skin of the patient just above the inguinal region of the patient, with the inflatable pelvis cushion of the disposable pelvis positioner assembly in the deflated state, after attaching the chest body contact sheet and the pelvic body contact sheet, transferring the patient from the supine position to a prone position, thereby positioning the patient to lie on the patient support structure in a prone position, with the chest body contact sheet attached to the chest of the patient and the pelvic body contact sheet attached to the pelvic region of the patient and the patient in the prone position, inflating the inflatable chest cushion and the inflatable pelvis cushion, thereby lifting the patient from the patient support structure by making the inflatable chest cushion and the inflatable pelvis cushion together bear the weight of the torso of the patient while the patient is in the prone position on the patient support structure with the abdominal region of the patient being decompressed.

2. The method according to claim 1, wherein pressure in the inflatable chest cushion and/or the inflatable pelvis cushion is reduced using a pressure relief valve of the inflatable chest cushion and/or the inflatable pelvis cushion.

3. The method according to claim 2, wherein the pressure relief valve is a manually operable pressure relief valve and two hands are used for actuation of the manually operable pressure relief valve.

4. The method according to claim 1, wherein at least one of the supraclavicular region, the lateral cutaneous nerve, the vena saphena magna, the arterie femoralis, the breasts in case of a female patient, and/or the genital region of the patient is decompressed while the patient is in the prone position on the patient support structure with the inflated pelvis cushion and the inflated chest cushion bearing the weight of the torso of said patient.

5. The method according to claim 1, wherein the patient positioner system is provided with the chest body contact sheet of the disposable chest positioner assembly being on the rear surface further provided with a central adhesive zone, which central adhesive zone has a shape that is configured to generally correspond to the shape of a human breastbone or a part thereof as seen from the ventral side of the patient in which method the chest body contact sheet is attached to the patient by first attaching the central adhesive zone to the patient and then attaching the upper and lower adhesive zones to the patient.

6. The method according to claim 1, wherein the patient is positioned in a jackknife position on the patient support structure, with the patient lying face down, with the hips at a level above the head and above the legs.

7. The method according to claim 1, wherein the patient is positioned on the patient support structure with hyperflexion of the cervical spine.

8. The method according to claim 1, wherein the inflatable chest cushion has in the inflated state a shape that is configured to leave the clavicle and manubrium sterni free or at least does not extend beyond the clavicle and manubrium sterni of the patient.

9. The method according to claim 1, wherein the inflatable chest cushion and the inflatable pelvis cushion are inflated using compressed air.

10. The method according to claim 1, wherein the chest body contact sheet is further provided with a left adhesive zone and a right adhesive zone, and the chest body contact sheet is attached to the chest of the patient on four sides.

11. The method according to claim 1, wherein the pelvic body contact sheet is further provided with a left adhesive zone and a right adhesive zone, and the pelvic body contact sheet is attached to the pelvic region of the patient on four sides.

* * * * *